US006566574B1

(12) United States Patent
Tadros et al.

(10) Patent No.: US 6,566,574 B1
(45) Date of Patent: May 20, 2003

(54) FORMULATIONS FOR NEUTRALIZATION OF CHEMICAL AND BIOLOGICAL TOXANTS

(75) Inventors: Maher E. Tadros, Albuquerque, NM (US); Mark D. Tucker, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 141 days.

(21) Appl. No.: 09/607,586

(22) Filed: Jun. 29, 2000

Related U.S. Application Data

(63) Continuation-in-part of application No. 09/109,235, filed on Jun. 30, 1998, now abandoned.
(60) Provisional application No. 60/146,432, filed on Jul. 29, 1999.

(51) Int. Cl.[7] ..... A62D 3/00; B01F 17/18; B01F 17/38; C11D 1/62; C11D 3/39

(52) U.S. Cl. ..... 588/200; 252/186.41; 510/110; 510/370; 510/372; 510/504; 516/15; 588/218; 588/221; 588/901

(58) Field of Search ..... 516/15; 252/186.41; 510/110, 372, 504, 370; 588/200, 901, 218, 221

(56) References Cited

U.S. PATENT DOCUMENTS

| | | | | | |
|---|---|---|---|---|---|
| 3,810,788 | A | * | 5/1974 | Steyermark | 510/110 X |
| H366 | H | * | 11/1987 | Seiders | 510/110 X |
| 4,824,602 | A | | 4/1989 | Juneja | |
| 4,850,729 | A | * | 7/1989 | Kramer et al. | 510/110 X |
| 5,078,896 | A | * | 1/1992 | Rorig et al. | 510/372 |
| 5,421,906 | A | * | 6/1995 | Borah | 510/370 X |
| 5,760,089 | A | * | 6/1998 | Cronce | 588/200 |
| 6,245,957 | B1 | * | 6/2001 | Wagner et al. | 588/200 |

OTHER PUBLICATIONS

Yang, Y.C., "Chemical Reactions for Neutralising Chemical Warfare Agents," Chem. Ind., 1995, 9, 334–337.

Yang, Y.C., Berg, F.J., Szafraniec, L.L., Beaudry, W.T., Bunton, C.A., and Kumar. A., "Peroxyhydrolysis of Nerve Agent VX and Model Compounds and Related Nucleophilic Reactions," J. Chem. Soc., Perkin Trans., 1997, 2, 607–613.

Moss, R.A., and Zhang, H., "Toward a Broad Spectrum Decontaminant for Reactive Toxic Phosphates/Phosphonates: N–Alkyl–3–Iodosopyridinium–4–Carboxylates," Tetrahedron Letters, 1993, 34, 6225–6228.

Moss, R.A., Kim, K.Y., and Swarup, S., "Efficient Catalytic Cleavage of Reactive Phosphates by an o–Iodosobenzoate Functionalized Surfactant," J. Amer. Chem. Soc., 1986, 108, 788–793.

Burkett, S., Sims, S., and Mann, S., "Synthesis of Hybrid Inorganic–organic Mesoporous Silica by Co–condensation of Siloxane and Organosiloxane Precursors," Chem. Commun., 1996, 11, 1367–1368.

King, W.L., and Gould, G.W., "Lysis of Bacterial Spores with Hydrogen Peroxide," J. Appl. Bacteriol., 1969, 32, 481–490.

Gould, G.W., Stubbs, J.M., and King, W.L., "Structure and Composition of Resistant Layers in Bacterial Spore Coats," J. Gen. Microbiol., 1969, 60, 347–355.

Tucker, M.D., Williams, C.V., Tadros, M.E., Baca, P.M., Betty, R. and Paul, J., "Aqueous Foam for the Decontamination and Mitigation of Chemical and Biological Warfare Agents," Sandia Technical Report SAND2000–1419, 2000, Sandia National Laboratories, Albuquerque, New Mexico.

Ford, M.S., and Newton, W.E., "International Materiel Evaluation of the German C8 Emulsion," DPG–FR–88–009, 1989 Final Report, U.S. Army Dugway Proving Ground: Dugway, UT.

Leslie, D.R., Beaudry, W.T., and Szafraniec, L.L., "Sorption and Reaction of Chemical Agents by a Mixed Sorptive/Reactive Resin," CRDEC–TR–292, 1991, CRDEC: Aberdeen Proving Ground, MD.

Sagripanti, J.L., and Bonifacino, A., "Comparative Sporicidal Effects of Liquid Chemical Agents," Appl. Environ. Microbiol., 1996, 62, 545–551.

Raber, E., McGuire, R., Shepley, D., Hoffman, M., Alcarez, A., Earl, W., and Currier, R., "Oxidizers: The Solution for Chemical Agent Decontamination," DOE Chemical and Biological Nonproliferation Program, 1998 Summer Meeting, Washington D.C.

Russell, A.D., "Bacterial Spores and Chemical Sporicidal Agents," Clinical Microbiol. Rev., 1990, 3(2), 99–119.

Richardson, G.A., "Development of Package Decontaminating System," EACR–1310–17, Final Report, 1972, Contract DAAA15–71–C–0508.

(List continued on next page.)

*Primary Examiner*—Richard D. Lovering
(74) *Attorney, Agent, or Firm*—Elmer A. Klavetter

(57) ABSTRACT

A formulation and method of making that neutralizes the adverse health effects of both chemical and biological compounds, especially chemical warfare (CW) and biological warfare (BW) agents. The formulation of the present invention non-toxic and non-corrosive and can be delivered by a variety of means and in different phases. The formulation provides solubilizing compounds that serve to effectively render the chemical and biological compounds, particularly CW and BW compounds, susceptible to attack and at least one reactive compound that serves to attack (and detoxify or kill) the compound. The at least one reactive compound can be an oxidizing compound, a nucleophilic compound or a mixture of both. The formulation can kill up to 99.99999% of bacterial spores within one hour of exposure.

23 Claims, 20 Drawing Sheets

OTHER PUBLICATIONS

Wagner, G.W., and Yang, Y.C., "Baking Soda, Hydrogen Peroxide, Alcohol: The Refreshing, Universal Decon for VX, GB and HD," Scientific Conference on Chemical and Biolgical Defense Research, Nov. 1998, ERDEC, Aberdeen Proving Ground, MD.

Drago, R.S., Frank, K.M., Wagner, G.W., and Yang, S.C., "Catalytic Activation of Hydrogen Peroxide—A Green Oxidant System," 1997, In Proceedings of the 1997 ERDEC Scientific Conference on Chemical and Biological Defense Research, Aberdeen Proving Ground, MD.

Tadros, M.E., Bridger, K., Berrier, A., Hearns, R., and Woodbury, D., "Enhanced Hydrolyses of Diphenyl Chlorophosphate and Agent GD by Tetrapentyl Ammonium Bromide,"1986, Scientific Conference on Chemical and Biological Defense Research, Nov. 1986, ERDEC, Aberdeen Proving Ground, MD.

* cited by examiner

FORMULATIONS FOR NEUTRALIZATION OF CHEMICAL AND BIOLOGICAL TOXANTS

CROSS REFERENCE TO RELATED APPLICATIONS

This application is a continuation-in-part of U.S. patent application Ser. No. 09/109,235, filed on Jun. 30, 1998, now abandoned, and claims the benefit of Provisional Application Ser. No. 60/146,432, filed on Jul. 29, 1999.

This invention was made with support from the United States Government under contract DE-AC04-94AL85000 awarded by the U.S. Department of Energy. The Government has certain rights in this invention.

BACKGROUND OF THE INVENTION

The present invention is directed to materials for neutralization of chemical and biological compounds or agents, and especially chemical and biological weapons agents and their method of making. In particular, the present invention is directed to materials containing solubilizing compounds and reactive compounds that can be delivered as foams, sprays, liquids, fogs and aerosols to enhance the rate of reactions leading to neutralization of chemical compounds, and other additives which serve to kill or attenuate certain biological compounds or agents.

Terrorist threats, potentially involving weapons of mass destruction, are increasing both in the United States and abroad. The use, and threat of use, of chemical and biological agents in the context of weapons of mass destruction are of paramount concern both to national defense as well as to state and local law enforcement.

Certain CW agents known to pose a threat by terrorists share chemical characteristics that present an opportunity for the development of countermeasures. The chemical agents sarin, soman, and tabun (G-agents) are all examples of phosphorus-containing compounds which, when altered chemically, can lose their toxicity. Mustard, which is an example of the H-agents, and VX, which is an example of the V-agents, can also be altered chemically and rendered harmless. In addition, certain of the known BW agents include botulinum toxin, anthrax and other spore-forming bacteria, vegetative bacteria, including plague and various viruses can also be deactivated chemically.

A CW or BW attack can involve either local placement or wide dispersal of the agent or agents so as to affect a population of human individuals. Because of the flexibility with which CW and BW (CBW) agents can be deployed, respondents might encounter the agents in a variety of physical states including bulk, aerosol and vapors.

An effective, rapid, and safe (non-toxic and non-corrosive) decontamination technology is required for the restoration of civilian facilities in the event of a domestic terrorist attack. Ideally, this technology should be applicable to a variety of scenarios such as the decontamination of open, semi-enclosed, and enclosed facilities as well as sensitive equipment. Examples of types of facilities where the decontamination formulation may be utilized include a stadium (open), an underground subway station (semi-enclosed), and an airport terminal or office building (enclosed).

Decontamination of chemical compounds have focused primarily on chemical warfare agents, particularly on the nerve agents (such as G agents and V agents) and on the blistering agents (such as mustard gas, or simply, mustard).

Reactions involved in detoxification of chemical agents can be divided into substitution and oxidation reactions. Decontamination of biological agents is primarily focused on bacterial spores (e.g., anthrax) which are considered to be the most difficult of all microorganisms to kill.

Substitution Reactions

Hydrolysis of chemical agents can be carried out with water, hydroxyl ions or other nucleophiles. The rate of hydrolysis of mustard and the nature of the products formed depends primarily on the solubility of the agent in water and on the pH of the solution. In the detoxification of mustard, for example, the molecule first forms a cyclic sulfonium cation, which reacts with nucleophilic reagents (Yang, 1995). The dominant product is thiodiglycol but this product may react with sulfonium ions to give secondary intermediates.

The hydrolysis of sarin (GB) and soman (GD) occurs rapidly under alkaline conditions and gives the corresponding O-alkyl methylphosphonic acid. In contrast, the hydrolysis of VX with $OH^-$ ions is more complex. In addition to displacement of the thioalkyl group (i.e., P—S bond breakage), the O-ethyl group is displaced (i.e., P—O bond breakage) producing a toxic product known as EA-2192 (Yang et al., 1997). Nucleophiles enter and depart the intermediate from an apical position. Electronegative groups, such as RO groups, preferentially occupy apical positions and groups that are bulky or electron donors, such as RS groups, occupy equatorial positions. The final product will depend on the balance between apicophilicity and leaving group ability. The result is that P—S bond cleavage is favored over P—O bond cleavage by a factor of about 5. Peroxyhydrolysis, on the other hand, using $OOH^-$ ions in alkaline medium was shown to involve quantitative P—S cleavage at rates 30–40 times that with $OH^-$. This selectivity was related to the relative basicities of the anionic nucleophile and the leaving anions.

Catalytic species for acceleration of substitution reactions have been reported. One example is o-iodosobenzoate (IBA). An example illustrating the catalytic reactions of this compound is given by Moss and Zhang (1993). In this example, IBA is converted to iodoxybenzoate (IBX) via oxidation that then participates in the reaction with the CW agent.

The IBA compound was also functionalized to introduce surface activity (surfactant character) to the active group (Moss et al., 1986). Metal ion-amine complexes, with surface active moiety, were also developed and shown to exhibit catalytic effects in substitution reactions. Enzymes such as organophosphorous acid anhydrolase have also been shown to accelerate substitution reactions with the G and VX agents.

Oxidation Reaction

Oxidative decontamination methods are useful for mustard and VX (Yang, 1995). An early oxidant used was potassium permanganate. Recently, a mixture of $KHSO_5$, $KHSO_4$, and $K_2SO_4$ was developed. Several peroxygen compounds have also been shown to oxidize chemical agents (e.g., perborate, peracetic acid, m-chloroperoxybenzoic acid, magnesium monoperoxyphthalate, and benzoyl peroxide). More recently, hydroperoxycarbonate anions produced by the reaction of bicarbonate ions with hydrogen peroxide have been shown to effectively oxidize mustard and VX. Polyoxymetalates are being developed as room temperature catalysts for oxidation of chemical agents but the reaction rates are reported to be slow at this stage of development. Some of these compounds undergo a color change upon interaction with chemical agents to indicate the presence of chemical agents.

The BW threat can be more serious than the CW threat. This is in part because of the high toxicity of BW agents, their ease of acquisition and production, and difficulty in detection. There are hundreds of biological warfare agents available for use by terrorists. They may be grouped into the categories of spore forming bacterium (e.g., anthrax), vegetative bacterium (e.g., plague, cholera), virus (e.g., smallpox, yellow fever), and bacterial toxins (e.g., botulism, ricin). Bacterial spores are recognized to be the most difficult microorganism to kill.

Bacterial spores are highly resistant structures formed by certain gram-positive bacteria usually in response to stresses in their environment. The most important spore-formers are members of the genera, Bacillus and Clostridium. Spores are considerably more complex than vegetative cells. The outer surface of a spore consists of the spore coat that is typically made up of a dense layer of insoluble proteins usually containing a large number of disulfide bonds. The cortex consists of peptidoglycan, a polymer primarily made up of highly crosslinked N-acetylglucosamine and N-acetylmuramic acid. The spore core contains normal (vegetative) cell structures such as ribosomes and a nucleoid.

Since their discovery, considerable research has been carried out to investigate methods to kill bacterial spores. Although spores are highly resistant to many common physical and chemical agents, a few antibacterial agents are also sporicidal. However, many powerful bactericides may only be inhibitory to spore germination or outgrowth (i.e., sporistatic) rather than sporicidal. Examples of sporicidal reagents, using relatively high concentrations, include glutaraldehyde, formaldehyde, iodine and chlorine oxyacids compounds, peroxy acids, and ethylene oxide. In general, all of these compounds are considered to be toxic.

There are several mechanisms generally recognized for spore kill. These mechanisms can operate singularly or simultaneously. In one mechanism, the dissolution or chemical disruption of the outer spore coat can allow penetration of oxidants into the interior of the spore. Several studies (King and Gould, 1969; Gould et al., 1970) suggest that the S—S (disulfide) rich spore coat protein forms a structure which successfully masks oxidant-reactive sites. Reagents that disrupt hydrogen and S—S bonds increase the sensitivity of spores to oxidants.

Peptidoglycan, which is loosely cross-linked and electronegative, makes up the cortex of a spore. In another mechanism, cationic interaction between a disinfectant solution and peptidoglycan can cause collapse of the cortex and loss of resistance.

The peptidoglycan of spore-forming bacteria contains teichoic acids (i.e., polymers of glycerol or ribitol joined by phosphate groups). In another mechanism, disruption of the teichoic acid polymers can cause deficiencies in the peptidoglycan structure making the spore susceptible to attack.

Additionally, certain surfactants can increase the wetting potential of the spore coat to such an extent as to allow greater penetration of oxidants into the interior of the spore.

There are a variety of materials that can be used to address the decontamination of one or more CW or BW agents. Historically, decontamination solutions have focused strictly on the kill and neutralization of chemical and biological agents. Little emphasis has been placed on restoration and re-use of facilities and equipment. Instead, these items were considered to be expendable and were expected to be replaced in the event of a CBW (both CW and BW) attack. Thus, most decontamination formulations currently in use are both highly toxic and highly corrosive. Additionally, most of the materials used for decontamination address either CW or BW but not both and often only a subclass of either CW or BW agents.

The neutralization of chemical warfare agents began by using bleaching powder to neutralize mustard agent. Supertropical bleach, a mixture of 93% calcium hypochlorite and 7% sodium hydroxide, was then formulated and is more stable than bleach in long-term storage and easier to spread. Mustard gas reacts with bleach by oxidation of the sulfide to sulfoxide and sulfone and by dehydrochlorination to form compounds such as $O_2S(CHCH_2)_2$. The G agents are converted by hydrolysis to the corresponding phosphonic acids with the hypochlorite anion acting as a catalyst. In acidic solutions, VX is oxidized rapidly by bleach at the sulfur atom and dissolves by protonation at the nitrogen. On the other hand, at high pH, the solubility of VX is significantly reduced and the deprotonated nitrogen is oxidized leading to consumption of greater than stoichiometric amounts of bleach.

A non-aqueous liquid composed of 70% diethylenetriamine, 28% ethylene glycol monomethyl ether, and 2% sodium hydroxide, referred to as Decontamination Solution Number 2 (DS2), is a highly effective decontaminant for CW agents. Ethylene glycol monomethyl ether has shown tetragonicity in mice and replacement with propylene glycol monomethyl ether was proposed to produce a new formulation referred to as DS2P. In addition, DS2 attacks paints, plastics, and leather materials. To minimize these problems, the contact time with DS2 is generally limited to 30 minutes followed by rinsing with large amounts of water. Personnel handling DS2 are required to wear respirators with eye shields and chemically protective gloves. The reactions of DS2 with mustard lead to elimination of HCl. The nerve agents react with DS2 to form diesters, which further decompose to the corresponding phosphonic acid. DS2 is not very effective in killing spores. Only 1-log kill (90%) was observed for *Bacillus subtilis* after 1 hour of treatment (Tucker, 2000).

A mixture consisting of 76% water, 15% tetrachloroethylene, 8% calcium hypochlorite, and 1% anionic surfactant mix was shown to enhance the solubility of agents but contains toxic and corrosive material (Ford and Newton, 1989). It is also not stable towards segregation.

There are a variety of formulations that are currently used for the decontamination of personnel in the event of a CW agent attack, primarily used by the U.S. military and are, in general, not utilized in the civilian community. One formulation is a M258 skin decontamination kit that mimics a Soviet kit recovered in Egyptian tanks in the Yom Kippur war. The kit consists of two packets: Packet I contains a towelette prewetted with phenol, ethanol, sodium hydroxide, ammonia, and water. Packet II contains a towelette impregnated with chloramine-B and a sealed glass ampoule filled with zinc chloride solution. The ampoule in packet II is broken and the towelette is wetted with the solution immediately prior to use. The presence of zinc chloride maintains the pH of the chloramine-B in water between 5 and 6 which would otherwise rise to 9.5.

Another formulation is the M291 kit, which is a solid sorbent system (Yang, 1995). The kit is used to wipe bulk liquid agent from the skin and is composed of non-woven fiber pads filled with a resin mixture. The resin is made of a sorptive material based on styrene/divinylbenzene and a high surface area carbonized macroreticular styrene/divinylbenzene resin, cation-exchange sites (sulfonic acid groups), and anion-exchange sites (tetraalkylammonium hydroxide groups). The sorptive resin can absorb liquid agents and the reactive resins are intended to promote hydrolysis of the reactions. However, a recent NMR study has shown neither VX nor a mustard simulant were hydrolyzed on the XE-555 resin surface during the first 10 days (Leslie et al., 1991). GD slowly hydrolyzed with a half-life of about 30 hours. The observed rapid agent decontamination in the field is achieved physically by wiping. This resin blend was found to be less corrosive to the skin than the M258 system.

Most formulations used for the decontamination of BW agents by both military and civilian agencies contain the hypochlorite anion (i.e., bleach or chlorine-based solutions). Solutions containing concentrations of 5% or more bleach have been shown to kill spores (Sapripanti and Bonifacino, 1996). A variety of hypochlorite solutions have been developed for decontamination of BW agents including 2–6 percent aqueous sodium hypochlorite solution (household bleach), a 7 percent aqueous slurry or solid calcium hypochlorite (HTH), 7 to 70 percent aqueous slurries of calcium hypochlorite and calcium oxide (supertropical bleach, STB), a solid mixture of calcium hypochlorite and magnesium oxide, a 0.5 percent aqueous calcium hypochlorite buffered with sodium dihydrogen phosphate and detergent, and a 0.5 percent aqueous calcium hypochlorite buffered with sodium. Although all of these solutions, with varying efficiency, are capable of killing spores, each is also highly corrosive to equipment and toxic to personnel.

The compounds that have been developed for use in detoxification of both CW and BW agents have been deployed in a variety of ways, including liquids, foams, fogs and aerosols). Stable aqueous foams have been used in various applications including fire fighting and law enforcement applications (such as prison riot containment). Such foams, however, have typically been made using anionic surfactants and anionic or nonionic polymers. These foams, unfortunately, have not been effective in the chemical decomposition and neutralization of most chemical and biological weapons (CBW) agents. They did not have the necessary chemical capabilities to decompose or alter CW agents, and they are not effective in killing or neutralizing the bacteria, viruses and spores associated with some of the more prevalent BW agents.

Gas phase reagents are attractive for decontamination if an environmentally acceptable gas can be identified. The advantage of gas decontaminants is their penetrating (diffusing) capability that makes them a necessary complement to the other decontamination techniques. Ozone, chlorine dioxide, ethylene oxide, and paraformaldehyde have all been investigated for decontamination applications. These are all known to be effective against biological agents. The effectiveness of ozone for killing spores appears to be well established (Raber et al., 1998). While ozone is an attractive decontaminant, experiments by Edgewood Chemical Biological Center (ECBC) show that it is not effective towards GD and with VX it leads to the formation of toxic products via P—O bond cleavage (Hovanic, 1998).

Useful would be materials that are effective for neutralizing both chemical and biological agents, that are environmentally benign to both people and property, that work on all currently anticipated material surfaces, and that can be incorporated into a wide variety of carriers (foams, gels, fogs, aerosols) that satisfy a wide variety of operational objectives.

DETAILED DESCRIPTION OF THE INVENTION

The present invention addresses the need for a general formulation that neutralizes the adverse effects of either or both chemical and biological toxants, where a toxant is defined as any chemical or biological compound, constituent, species, or agent that through its chemical or biological action on life processes can, if left untreated, cause death, temporary incapacitation, or permanent harm to humans or animals. This includes all such chemicals or biological agents, regardless of their origin or of their method of production, and regardless of whether they are produced in facilities, in munitions or elsewhere. Neutralization is defined as the mitigation, de-toxification, decontamination, or otherwise destruction of toxants to the extent that the toxants no longer cause acute adverse effects to humans or animals. The formulation and described variations of the present invention can neutralize, and does not itself contain or produce, infection, significant adverse health effects, or even fatality in animals. One important subset of chemical and biological compounds that the present invention addresses is that of chemical warfare (CW) and biological warfare (BW) agents. However, the present invention also addresses toxants that can cause potential adverse health effects to animals, including humans, where such adverse health effects include infections, acute and chronic health effects, and fatalities. Additionally, the present invention addresses the need for such a formulation that is itself non-toxic and non-corrosive and that can be delivered by a variety of means and in different phases.

Figure 1:
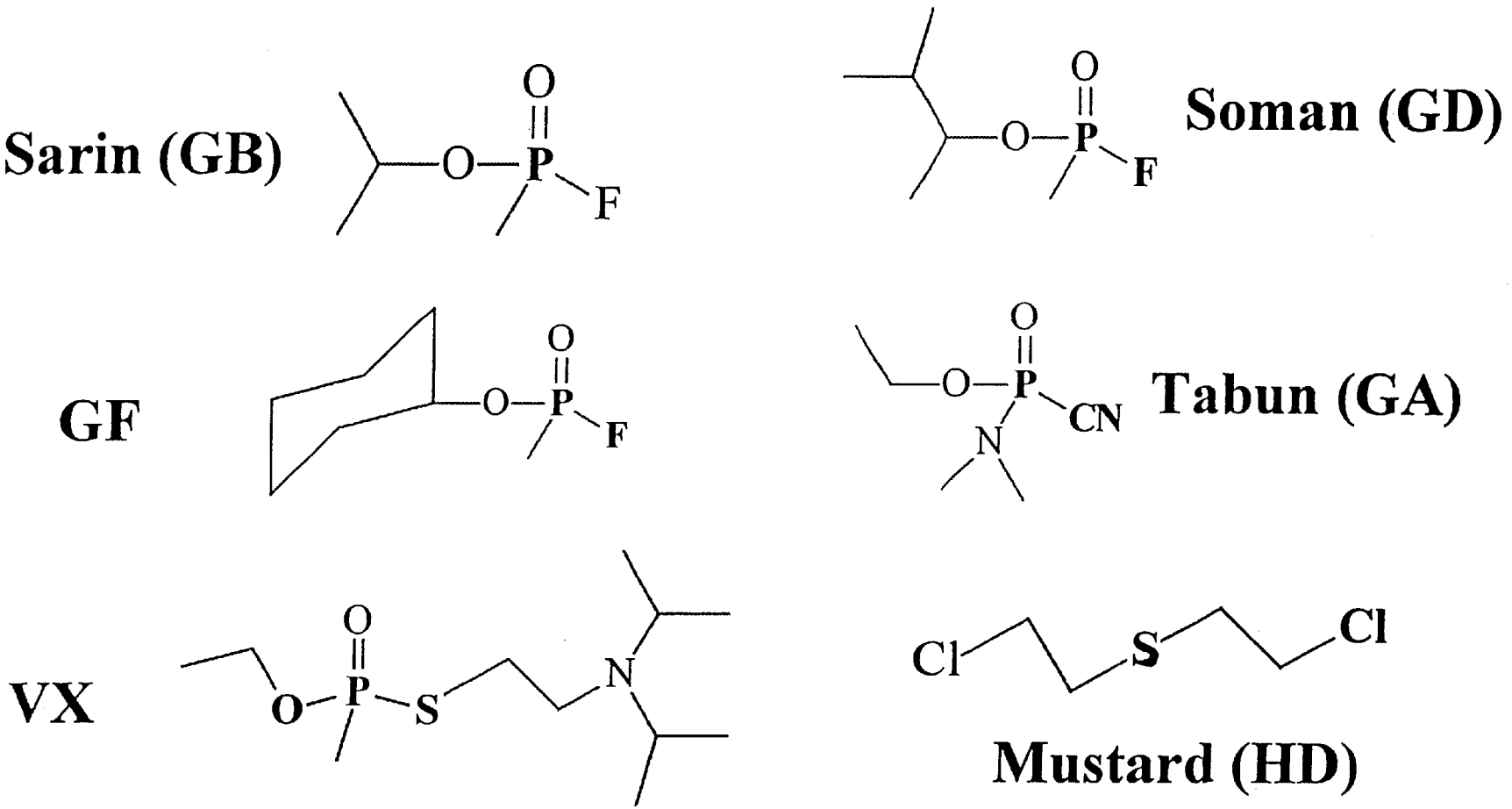
FIG. 1 illustrates portions of the chemical structures, relevant to the claimed invention, of certain CW agents.

Generally, the most severe chemical and biological compounds to which the present invention can be usefully applied are CW and BW agents. The present invention has been shown to successfully neutralize or detoxify CW and BW agents and can be applied to less severe chemical and biological toxants. Certain of the known CW agents which are likely to pose a threat from terrorists share chemical similarity in the fact that they are phosphorus-containin compounds which can be altered when subjected to nucleophilic attack or oxidation processes. Among these are included sarin (O-isopropyl methylphosphonofluoridate), soman (O-pinacolyl methylphosphonofluoridate), tabun (O-ethyl N,N-dimethyl phosphoramidocyanidate) and VX (O-ethyl S-2-diisopropylaminoethyl methyl phosphonothiolate). The chemical structures of these compounds are shown in FIG. 1. In each of these agents, if the phosphorous-containing compound is chemically altered by hydrolysis or oxidation, it can be detoxified and thereby neutralized as a CW agent. These nerve agents are only sparingly soluble in water.

Also shown in FIG. 1 is the chemical structure of mustard (bis(2-chloroethyl)sulfide). Although mustard is chemically quite distinct from the other CW agents mentioned above, in that it does not share the phosphorus-containing group, it does exhibit chlorine atoms bound to carbon atoms at both ends of the molecule. These carbon-to-chlorine bonds can also be subjected to hydrolysis and the central sulfur can be oxidized to sulfone and sulfoxide, thereby rendering the molecule ineffective as a CW agent. Like the nerve agents, mustard is only sparingly soluble in water.

The mechanism for the kill or destruction of BW agents by the formulation of the present invention is not well understood. In the case of vegetative bacterial cells and viruses, the kill mechanism is most likely due to the oxidizing effect of oxidizers such as hydrogen peroxide (Russell, 1990). Typically, hydrogen peroxide concentrations from 10–20% are required for spore kill (Russell, 1990). Low concentrations of hydrogen peroxide (such as 4% or less) are known to not effectively kill bacterial spores. The spore DNA must be exposed to the oxidizer to detoxify the spore agent. The spore coat protects the DNA and must be breached to effectively kill the spore agent.

In the present invention, the formulation provides at least one solubilizing compound that serves to effectively render the toxant or toxants, both chemical and biological, particularly CW and BW compounds, susceptible to attack and at least one reactive compound that serves to attack and neutralize the toxant or toxants. The at least one reactive compound can be an oxidizing compound, a nucleophilic compound or a mixture of both; the compound can be both oxidizing and nucleophilic. The solubilizing compound, for the case of CW agents and similarly-structured chemical compounds, serves to solubilize the sparingly soluble CW agents and attract the nucleophilic/oxidizing compound to a position in close proximity to the CW agent. This is accomplished because the nucleophilic compounds are negatively charged and the solubilizing compound can be a cationic surfactant that forms micelles that are positively charged, thereby attracting nucleophiles such as hydroxyl ions, hydroperoxide ions, or hydropercarbonate ions. With respect to BW agents, the solubilizing agent serves to solubilize and soften the biological agent outer coat to provide better access of the reactive compound to the BW agent DNA, facilitating the kill capability or neutralization capability of the formation.

Although the formulation of the present invention has some similarities to commercially available detergents and shampoos in that cationic surfactants are used to form micellar solutions (see for example, Juneja, U.S. Pat. No. 4,824,602) these solutions do not contain a reactive compound that can neutralize toxants according to the present invention. Moreover, formulations such as those suggested in Juneja do not contain cationic surfactants and cationic hydrotropes; the formulations of Juneja contain anionic hydrotropes.

Figure 2:
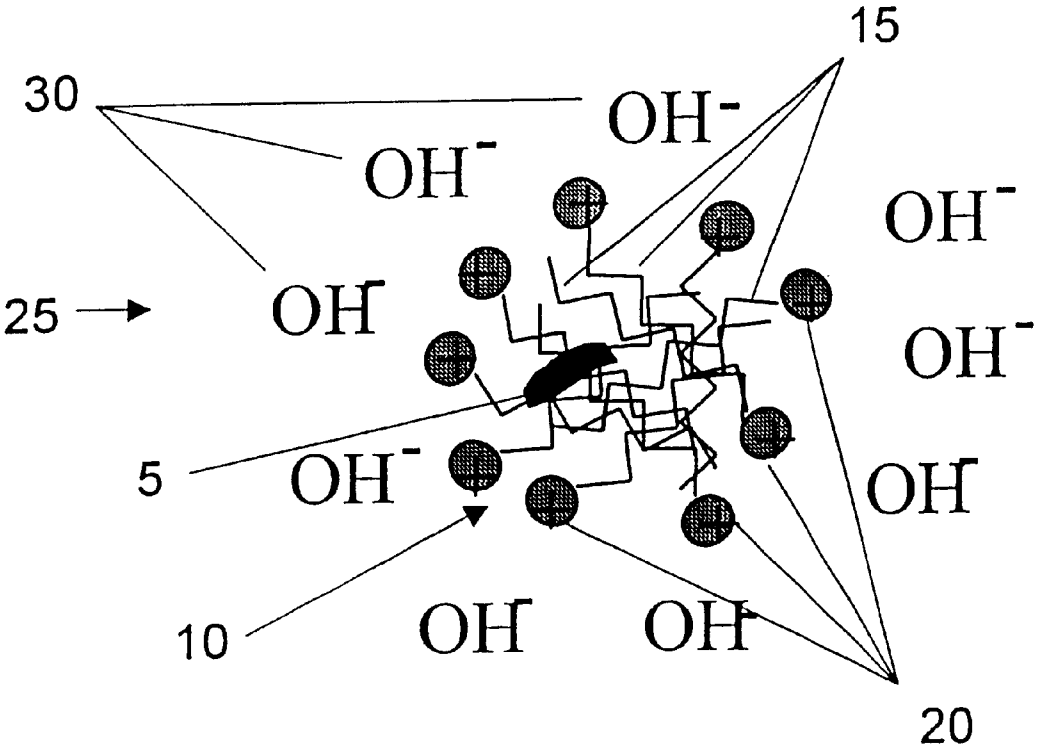
FIG. 2 illustrates how components of the foams of the present invention can form micelles.

FIG. 2 shows an example of a cationic micelle that is formed when the fomulation of the present invention is employed. In an aqueous environment 25, the hydrolyzable or oxidizable chemical toxant (such as a CW agent) 5 is located within a micelle 10 comprised of an aggregate of surfactant molecules with hydrophobic tails 15 forming the interior core of the micelle, and hydrophilic heads 20 concentrating at the surface of the micelle. As mentioned above, these positively-charged heads attract nucleophiles, with the consequence that reaction rate is enhanced. The figure also illustrates that negatively charged hydroxyl ions 30 are attracted to the micelle. This is in contrast with the situation, which would be observed with aqueous formulations utilizing anionic surfactants, in which the micelles are negatively charged and repel the hydroxyl ions.

Figure 3:
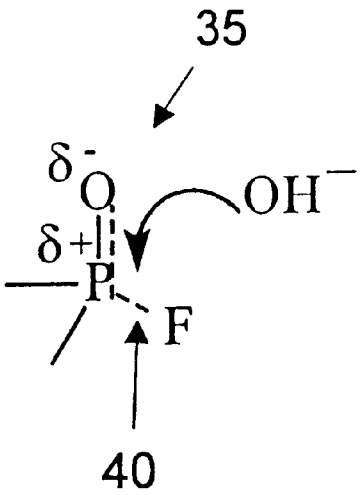
FIG. 3 illustrates the micellar catalysis mechanism of the present invention.

FIG. 3 illustrates the mechanism of a typical nucleophile-catalyzed reaction consistent with the principles of the present invention. The figure shows the portion of a toxant 35 that is subject to nucleophilic attack. In this example, the single covalent bond to be attacked is the bond 40 between the phosphorus atom and the fluorine atom. Due to the characteristics of the phosphorus to oxygen double bond, according to the phenomenon of partial charges well known to those skilled in chemistry, the phosphorus atom shown in the figure bears a partialpositive charge and hence, nucleophilic species such as hydroxyl ions are attracted to it. A reaction takes place whereby, in the case of hydroxyl being the nucleophile, the fluorine is replaced by hydroxyl group in the toxant, and hydrofluoric acid is liberated:

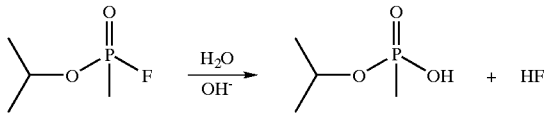

It should be noted that this mechanism of nucleophilic attack to detoxify toxants such as CW agents can operate with any strong nucleophile. The hydroxyl ions noted here are an example of nucleophilic species that are capable of serving this function in the present invention. Additionally, this mechanism of decontamination and neutralization will operate generally in cases where a toxant bears a phosphorus-containing chemical group that is vulnerable to nucleophilic attack. For example, a similar reaction will take place in instances wherein a cyanide group (such as in the case of tabun) is bound to the phosphorus in place of the fluorine atom discussed above. Likewise, (as in VX) a larger chemical group could be removed as a result of the same kind of nucleophilic attack and hydrolysis reaction, thereby rendering the toxant ineffective. In the particular case of the VX agent, the hydroxyl ion is not preferred as a nucleophile because it is not specific to cleavage of the P—S bond, it also breaks the P—O bond. This is not desirable because the reaction product is also highly toxic. Therefore, it is preferred to use other nucleophiles for detoxification of the VX agent. An example of nucleophiles specific to cleavage of the P—S bond are the hydroperoxide anion.

Hydrolysis will also take place in the case of mustard, although the mechanism of nucleophilic attack does riot operate in exactly the same way as in the case of the phosphorus containing toxants. As example of a reaction according to this mechanism is the following:

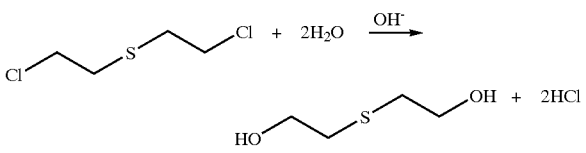

Hydrolysis is only one mechanism by which toxants such as CW agents may be detoxified. Oxidation can also result in detoxification of CW agents and other chemical compounds consistent with the principles of the claimed invention, as shown in the following example:

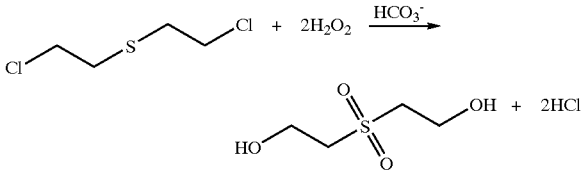

In one embodiment, the formulation of the present invention neutralizes toxants, such as CW and BW agents, and comprises solubilizing compounds which include both a cationic surfactant and a hydrotrope, also cationic, and at least one reactive compound, where the reactive compound can be a nucleophilic compound, an oxidizing compound (an oxidizer) or a mixture thereof. Although the focus of use for the formulations of the present invention are on CW and BW agents, the formulations can also be used on other toxants, both chemical and biological, that are hydrolyzable or oxidizable by the formulations of the present invention. The formulation is added to a carrier such as water in a fluid phase for delivery to the hydrolyzable or oxidizable toxants. In order to neutralize a toxant, the cationic surfactant solubilizes the sparingly soluble toxant and the cationic hydrotrope, an ionic-surfactant-like material with short hydrocarbon segments, is added to increase the solubility of the toxant in aqueous media and increase subsequent reaction rates between the reactive compound and the toxant. Anionic hydrotropic compounds such as sodium xylene surfactants are typically used in the detergent industry to solubilize surfactants and soil; however, in the context of the present invention, cationic hydrotropes are used to ensure compatibility with the cationic surfactants. To further enhance solubility and bulk viscosity, a water soluble polymer can be optionally added. The cationic hydrotrope also contributes significantly to increasing the rate of hydrolysis of the toxant. In order to neutralize biological toxants, the solubilizing agent can be a cationic surfactant, an alcohol such as a fatty alcohol or a cationic hydrotrope. Surfactants are known to denature proteins such as biological toxins and to act as bactericides and algaecides. Included among these are quaternary ammonium compounds such as benzalkonium chloride, cetylpyridinium chloride and cetyltrimethyl ammonium bromide. The cationic surfactants, fatty alcohols, and cationic hydrotropes serve to aid in exposing the biological toxant's DNA to the reactive compound. Therefore, the mixture of a cationic surfactant and a cationic hydrotrope provides the necessary set of solubilizing agents to enhance exposure of the toxants, especially CW and BW agents, to the reactive compound. After the solubilizing compound enhances exposure of a toxant to the reactive compound, the reactive compound reacts with the toxant, either by an oxidation or hydrolysis reaction, to neutralize the toxant. Depending upon the concentration of the various compounds used in the formulation of the present invention, greater than 99.999% and often as much as 99.99999% or more of biological toxants can be neutralized (killed) with approximately one hour.

For the purposes of this invention, the cationic surfactants are typically quaternary ammonium salts such as cetyltrimethyl ammonium bromide, benzalkonium and benzethonium chloride, and polymeric quaternary compounds. Examples of suitable hydrotropes include, but are not limited to, tetrapentyl ammonium bromide, triacetyl methyl ammonium bromide and tetrabutyl ammonium bromide. Examples of suitable water-soluble polymers include, but are not limited to, polyvinyl alcohol, guar gum, (cationic or nonionic) polydiallyl dimethyl ammonium chloride, and polyacrylamides.

The fatty alcohols can contain 10–16 carbon atoms. (Typically, the term "fatty alcohol" connotes a straight chain primary alcohol having between 8 and 20 carbon atoms.). The combined function of the polymer and the fatty alcohol is to increase the bulk as well as the surface viscosities of the foam lamellae and increase foam stability against drainage and bubble collapse. Other compounds that can be added include short-chain alcohols (at concentration between approximately 0 to 4 weight percent), which are used to aid in solubilization, and glycol ether, which is also used to solubilize fatty alcohols.

One reactive compound that can be added are oxidizing compounds (oxidizers) such as peroxides, for example, hydrogen peroxide and urea hydrogen peroxide, and percarbonates can be added to neutralize toxants, both chemical and biological, including spores and bacteria. The addition of bicarbonate, such as potassium bicarbonate or sodium bicarbonate, when the oxidizer is a peroxide compound, such as hydrogen peroxide, reacts to form hydroperoxycarbonate, which is especially effective in reacting with biological toxants to neutralize them. Other compounds that can be used in place of the carbonate compound include borate, molybdate, sulfate, and tungstate. In one embodiment, hydrogen peroxide is the main reactive reagent, and the bicarbonate compound is added to the formulation. Recent investigations have demonstrated that hydrogen peroxide can be activated by bicarbonate to form the highly reactive hydroperoxycarbonate ($HCO_4^-$) species (Richardson et al, 1998; Wagner and Yang, 1998). Additional studies have demonstrated that the oxidation of sulfides (e.g., mustard) by hydrogen peroxide can be significantly) accelerated by the presence of the bicarbonate ion since hydroperoxycarbonate is an effective oxidizer (Drago et al., 1997). In the case of mustard, hydroperoxycarbonate oxidizes the central sulfur to sulfone and/or sulfoxide. Other reactive compounds are nucleophilic compounds that include oximates such as butane-2,3-dione, monooximate ion and benzohydroxamate, alkoxides such as methoxide and ethoxide, and aryloxides such as aryl substituted benzenesulfonates.

In neutralizing biological toxants, it appears that a synergistic effect between the cationic surfactants and the hydrogen peroxide/bicarbonate (i.e., the hydroperoxycarbonate species) is responsible for the high rate of spore kill achieved in exposing the formulation to the spores. A possible mechanism for spore kill is that the cationic surfactants soften and disrupt the spore coat resulting in breeches through which hydrogen peroxide can enter and attack the spore DNA. This synergistic effect was confirmed by experimental results. Other oxidizing compounds that can be used to neutralize the spores include aldehydes, such as glutaraldehyde (at concentrations between 1–4%) and peroxymonosulfate (1–4%), Fenton's reagent (a mixture of iron and peroxide), and sodium hypochlorite.

The following table provides a list of constituents in one embodiment of the formulation of the present invention and a range of concentrations that have been shown to effectively neutralize toxants, both chemical and biological, where water was used as the carrier.

| | (wt. % of overall formulation) |
|---|---|
| Cationic surfactant | 0.1–10 |
| Hydrotrope | 0.1–10 |
| Water soluble polymer | 0–10 |
| Long chain fatty alcohol | 0–1 |
| Oxidizer/nucleophile | 0.1–10 |

The chemical toxants addressed by the formulation of the present invention include, but are not limited to, o-alkyl phosphonofluoridates, such as sarin and soman, o-alkyl phophoramidocyanidates, such as tabun, o-alkyl, s-2-dialkyl aminoethyl alkylphosphonothiolates and corresponding alkylated or protonated salts, such as VX, mustard compounds, including 2-chloroethylchloromethylsulfide, bis(2-chloroethyl)sulfide, bis(2-chloroethylthio)methane, 1,2-bis(2-chloroethylthio)ethane, 1,3-bis(2-chloroethylthio)-n-propane, 1,4-bis(2-chloroethylthio)-n-butane, 1,5-bis(2-chloroethylthio)-n-pentane, bis(2-chloroethylthiomethyl)ether, and bis(2-chloroethylthioethyl)ether, Lewisites, including 2-chlorovinyldichloroarsine, bis(2-chlorovinyl) chloroarsine, tris(2-chlorovinyl)arsine, bis(2-chloroethyl) ethylamine, and bis(2-chloroethyl)methylamine, saxitoxin, ricin, alkyl phosphonyidifluoride, alkyl phosphonites, chlorosarin, chlorosoman, amiton, 1,1,3,3,3,-pentafluoro-2-(trifluoromethyl)-1-propene, 3-quinuclidinyl benzilate, methylphosphonyl dichloride, dimethyl methylphosphonate, dialkyl phosphoramidic dihalides, dialkyl phosphoramidates, arsenic trichloride, diphenyl hydroxyacetic acid, quinuclidin-3-ol, dialkyl aminoethyl-2-chlorides, dialkyl aminoethan-2-ols, dialkyl aminoethane-2-thiols, thiodiglycols, pinacolyl alcohols, phosgene, cyanogen chloride, hydrogen cyanide, chloropicrin, phosphorous oxychloride, phosphorous trichloride, phosphorus pentachloride, alkyl phosphites, sulfur monochloride, sulfur dichloride, and thionyl chloride. These compounds, and other chemical compounds that can be neutralized (e.g., detoxified) by nucleophilic and oxidizing reactive agents of the present invention, are neutralized by the formulations of the present invention.

Additionally, catalysts have been successfully incorporated in the formulations of the present invention to enharice rates of reaction. For example, iodosobenzoate and copper amine complexes have been used and found to increase reaction rates. Other compounds may also be added to the formation as needed to enhance other reactions (such as oxidation reactions) with the toxants. It is anticipated that such additions will permit those skilled in the art to adapt the invention to their requirements without the need for undue experimentation and without departing from the spirit and scope of this disclosure and the appended claims.

One advantage of the formulation of the present invention is that the reactive compound and the carrier (generally, water) can be stored separately from the other compounds of the formulation prior to use. The separation of the reactive compound from the other compounds of the formulation is useful in increasing storage stability. Because water will generally be available at or near the site where neutralization needs to occur, the compounds associated with the formulation other than water do not need to be combined immediately with water but can be transported separately to the detoxification site and water added at that location and time. This aids in economy of transport. The formulation of the present invention is therefore suitable for use in a kit form.

In another embodiment, a formulation is provided that is used primarily for the neutralization of chemical toxants, such as CW agents, wherein the formulation comprises solubilizing compounds which include both a cationic surfactant and a cationic hydrotrope and at least one reactive compound, where the reactive compound can be a nucleophilic compound, an oxidizing compound (an oxidizer) or a mixture thereof. A water soluble polymer can be optionally added. This formulation is added to a carrier such as water in a fluid phase for delivery to the chemical toxant. After the solubilizing compound enhances exposure of the chemical toxant to the reactive compound, the reactive compound, generally a mild oxidizer such as a peroxide compound, reacts with the agent, either by an oxidation or hydrolysis reaction, to neutralize the chemical toxant.

In another embodiment, a formulation is provided that is used primarily for the neutralization of biological toxants wherein the formulation comprises a solubilizing compound selected from a cationic surfactant, a cationic hydrotrope, and a fatty alcohol, and at least one reactive compound, where the reactive compound can be a nucleophilic compound, an oxidizing compound (an oxidizer) or a mixture thereof. This formulation is added to a carrier such as water in a fluid phase for delivery to the biological toxant. After the solubilizing compound enhances exposure of the biological toxant to the reactive compound, the reactive compound reacts with the toxant, either by an oxidation or hydrolysis reaction, to neutralize the toxant. The reactive compound is generally a hydroperoxycarbonate compound that is formed by the addition of a hydrogen peroxide compound and a bicarbonate compound, such as potassium bicarbonate or sodium bicarbonate.

In one embodiment, the formulation of the present invention is comprised of the following compounds.

| Compound | Range of Concentration (wt. % of overall formulation) |
|---|---|
| one or more of cationic surfactant | 0.0–10 |
| long-chain fatty alcohol | 0–1 |

-continued

| Compound | Range of Concentration (wt. % of overall formulation) |
|---|---|
| or cationic hydrotrope | 0.0–10 |
| hydrogen peroxide | 0–4 |
| sodium bicarbonate | 0–4 |
| water | 71–91.9 |

Additionally, a water soluble polymer can be optionally added at a concentration range of 0–10 wt %. This formulation is particularly useful in neturalizing biological toxants. The formulation can be easily delivered or dispersed as a foam.

Cationic surfactants are typically quarternary ammonium salts such as cetyltrimethyl ammonium bromide. The fatty alcohols may contain 10–16 carbon atoms. Examples of suitable hydrotropes are tetrapentyl ammonium bromide, triacetyl methyl ammonium bromide, and tetrabutyl ammonium bromide. The combination of bicarbonate and hydrogen peroxide forms an oxidizer (the highly reactive hydroperoxycarbonate species) and is the actual killing agent for spores.

This formulation is both non-toxic to animals, including humans, and generally non-corrosive and can be used for the neutralization of toxants, both chemical and biological. The formulation allows decontamination of areas populated with both people and sensitive equipment. The formulation is especially useful in neutralization of BW agents such as anthrax. 7-log kill (99.99999%) of *Bacillus anthracis* spores (i.e., anthrax spores) was achieved in 1 hour in solution by this non-toxic, non-corrosive formulation (described subsequently).

The formulations of the present invention can be delivered to the toxants in a variety of manners and phases to provide the necessary detoxification (decontamination). One useful form of delivery is foam. A non-toxic, non-corrosive aqueous foam with enhanced physical stability for the rapid neutralization of toxants, especially CW and BW agents, has been developed as part of the present invention. The foam formulation is based on a surfactant system with hydrotropes to solubilize sparingly soluble toxants and to increase rates of reaction with nucleophilic reagents. The formulation also includes mild oxidizing agents to neutralize biological toxants and fatty alcohols and water-soluble polymers to enhance the physical stability of the foam.

This neutralization technology is attractive for civilian and military applications for several reasons including 1) a single neutralization solution can be used for both chemical and biological toxants, 2) it can be rapidly deployed 3) mitigation of agents can be accomplished in bulk, aerosol, and vapor phases, 4) it exhibits minimal health and collateral damage, 5) it requires minimal logistics support, 6) it has minimal run-off of fluids and no lasting environmental impact, and 7) it is relatively inexpensive. The foam formulation of the present invention can be delivered by various methods. One useful method is based on an aspiration or Venturi effect, which eliminates the need to pump additional air into a closed environment. Foams generated by this method have been shown to have a maximum expansion ratio of about 60–100:1 and have been shown to be stable for approximately 1–4 hours depending on environmental conditions (temperature, wind, relative humidity). The foam can also be generated by compressed air foam systems where air is directly injected into the liquid foam. Foam generated by this method generally has expansion ratios of about 20–60:1 and is also stable from 1–4 hours.

The foam can be deployed in a variety of devices, depending on the volume of foam that is desired. Successful deployment has occurred using small hand-held devices that are similar to fire extinguishers, and in large-scale foam generating devices. Using these devices, successful decontamination of both CW and BW agents and simulants has been demonstrated. For CW work, live agent testing has been conducted with GD (Soman), VX, and HD (Mustard). The half-lives for the decontamination of these agents in the foam system is on the order of 2 minutes to 20 minutes. Addressing BW agents, 7-log kill (99.99999%) of anthrax spores has been achieved after approximately a one hour exposure to the foam. Other BW work has demonstrated rapid kill of the simulants for plague (a vegetative bacterial cell) and for the smallpox virus.

The formulations of the present invention exploit the principles of cationic micelle catalysis and the solubilization power of cationic hydrotropes to dissolve the otherwise sparingly soluble toxants. The formulations of the invention can be dispensed as foam using foam-generating technology known to those skilled in the art. Especially suited to the objectives of the invention is foaming apparatus that employs Venturi principles whereby air is drawn into the foam-generating nozzle from the contaminated environment instead of from some other air source. This causes toxants in the air to be combined directly with the foam ingredients as the foam is made. In this way, the effectiveness of neutralization is enhanced significantly.

By employing use of the foam formulations of the present invention, in combination with mechanical foam generating devices well known to those knowledgeable about foam deployment, the desired rapid response and mitigation of bulk, aerosol and vapor Mediated weapons agents can be obtained. If foam-generating equipment is employed that draws ambient air from within the contaminated environment, contaminants in the air are forced into intimate physical contact with the foam lamellae. In this way, neutralization capabilities of the formulation of the invention are enhanced.

The foam provides a neutralization formulation which may be used for two general purposes: (1) to provide the first responder at the scene of a chemical or biological attack with the capability to rapidly respond to the event and to deal with potential casualties; and (2) to restore a facility to usefulness after an attack.

For the first responder, it is critical to decontaminate facilities or equipment to an acceptable level in a very short time so that casualties can be located and treated. In the restoration scenario, time is of less importance but collateral damage, public perception, and re-certification (i.e., complete decontamination) is of greater consequence. A common formulation effective against all chemical and biological agents is required that must be suitable for use on a wide variety of building materials commonly found in civilian facilities. Additionally, the neutralization formulation must be able to be rapidly deployed in large quantities by first responders to effectively neutralize chemical or biological toxants while remaining relatively harmless to both people and property. In addition, the formulation should render chemical and biological toxants harmless in a reasonable period of time so that relatively rapid restoration of facilities may be achieved.

The formulation of the present invention accomplishes these goals. The foam formulation of the present invention is effective for neutralizing both chemical and biological toxants; is environmentally benign to both people and property; works on all currently anticipated material surfaces; and can be incorporated into a wide variety of carriers (foams, gels, fogs, aerosols) that satisfy a wide variety of operational objectives.

Additionally, the formulation of the present invention has shown the capability to neutralize toxants in bulk, aerosol and vapor states, and which can be deployed in a variety of contexts to protect or clean up targets including equipment, open areas, facilities and buildings. The formulation of the present invention can also be used in disinfection scenarios for both animals and inanimate objects.

The foam formulation of the present invention is based on a cationic surfactant system with cationic hydrotropes to increase solubilization of chemical agents and reactivity with nucleophilic reagents. A mild oxidizing agent (a peroxide compound such as hydrogen peroxide) is also added to the foam at a low concentration. Hydrogen peroxide reacts with bicarbonate in the foam to form the highly reactive hydroperoxycarbonate species. In addition to these ingredients, the formulation also contains a water-soluble cationic polymer to increase the bulk viscosity of the solution and fatty alcohols to increase the surface viscosity of the formulation.

It is necessary to mix the constituents of the foam following a specific procedure in order to solubilize key ingredients such as the polymer and the fatty alcohols. Water and the cationic hydrotrope are mixed in a container. The alcohol compound or mixture of alcohol compounds are then added to this mixture. A water-soluble polymer is added, slowly to avoid lump formation, and dissolved. The polymer is optional but is added to increase the viscosity of the mixture, producing a more stable foam. The pH can be adjusted to facilitate solubilization of the polymer. The cationic surfactant is then added. A fatty alcohol, such as dodecanol, can be added to increase the foam surface tension to enhance the stability of the foam. Diethyleneglycol monobutylether, or a similar solvent, is generally used as a solvent for the fatty alcohol. The solution can be stored for later use. A preparation procedure for one embodiment in described in Example 3. The solution can be then mixed with the reactive compound, such as the peroxide compound. Generally, in practical use, the solution is pre-mixed and stored wherein the reactive compound is added later. The reactive compound, such as hydrogen peroxide is added to the formulation immediately before use because its reactivity degrades over time. Note that the hydrogen peroxide can be added to the foam in the form of a solid (urea hydrogen peroxide) which is considered to be safe for shipping and handling. This eliminates the need for handling highly concentrated liquid hydrogen peroxide.

Most foams are stored and deployed as concentrates. Typical fire fighting foams are available in concentrates ranging from 0.1% to 6%. In other words, for a 0.1% concentrate, every 100 gallons of foam is made up of 0.1 gallons of the concentrate solution and 99.9 gallons of water. For a 6% concentrate, every 100 gallons of foam is made up of 6 gallons of the concentrate solution and 94 gallons of water. The foam formulation of the present invention has also been developed as a concentrate. Formulations of between 14% to 25% have been developed (i.e., for a 25% concentrate, 100 gallons of foam is made up of 25 gallons of the concentrate solution and 75 gallons of water). One example of the preparation of a foam concentrate is given in Example 4. The foam concentrate does not include hydrogen peroxide and bicarbonate. These constituents would generally be added to the foam solution immediately before the use of the foam for decontamination purposes.

Useful attributes of the foam of the present invention are that the formulation has medium to high expansion ratios and is highly stable. The expansion ratio of a foam is defined as the ratio between the volume of foam produced and the original liquid volume. This property is important because higher expansion ratios allow less water usage during a decontamination event. However, if the expansion ratio is too high, there may not be enough water in the formulation for effective decontamination. In addition, at high expansion ratios (greater than about 60) it is difficult to produce a stream of foam that can be directed to various locations (i.e., the foam simply falls straight down as it leaves the foam generating nozzle). However, foam with high expansion ratios (approximately 80–120) is extremely effective for filling volumes of space and for blanketing large surface areas. On the other hand, foam with medium expansion ratios (approximately 20–60) is very effective for shooting at specific targets and for sticking to vertical surfaces and the underside of horizontal surfaces. The formulation of the present invention can be used to generate a foam with a medium expansion ratio and with a high expansion ratio in an aspirating air foam generating system by simply selecting the appropriate foam generating nozzle and controlling the bulk viscosity of the formulation. The bulk viscosity of the formulation determines its degree of spreading as it leaves the foam nozzle that allows the liquid to strike the cone of the nozzle in the appropriate location to generate a foam. All foam nozzles are designed for use with liquid formulations in specific bulk viscosity ranges. The water-soluble polymer was added at the appropriate concentration to give a bulk viscosity in the range of that required for the specific foam generating nozzles which were used. In a compressed air foam generating system, the expansion ratio is governed by changing the volume of air injected into the liquid stream.

An important physical property of a foam is its stability. Foam stability is measured by its half-drainage time, which is defined as the time required for a foam to lose half of its original liquid volume. For example, if 1 L of solution is used to generate a foam, the half-drainage time is defined as the amount of time for 500 ml to drain from the foam. This property is important because a stable foam allows a greater contact time between the formulation and the chemical or biological agent. Foam stability is achieved by increasing the time required for liquid to drain from the film. Increasing the surface viscosity of the liquid can control liquid drainage from the film. The higher the surface viscosity, the more stable the foam. The fatty alcohols increase the surface viscosity by packing in between the surface molecules and increasing the resistance to flow in the liquid film, thereby creating a more stable foam bubble. The foam formulation of the present invention produces a foam with half-drainage times of several hours.

Figure 4:
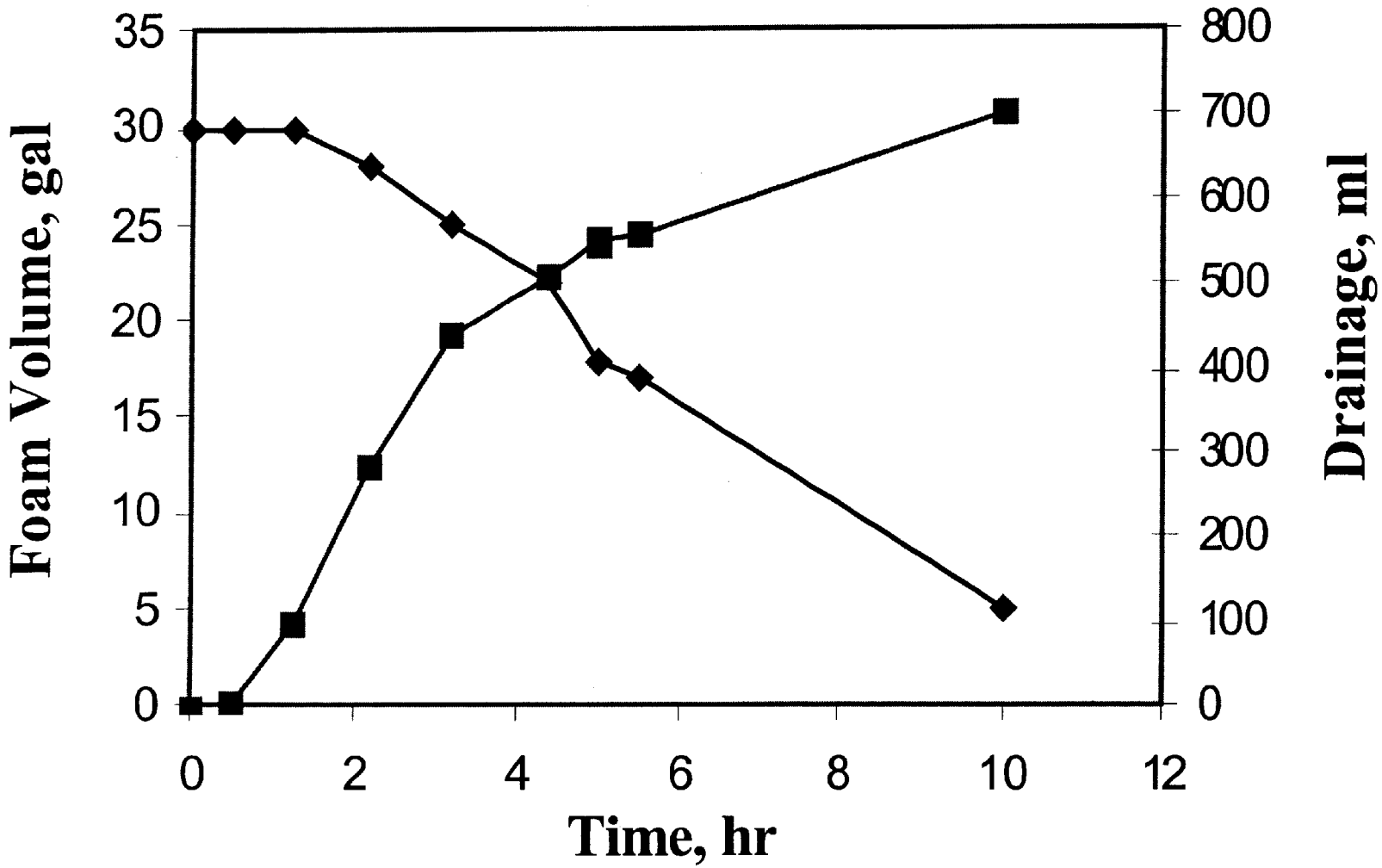
FIG. 4 shows the expansion ratio and stability of one embodiment of the foam of the present invention generated without hydrogen peroxide.
Figure 5:
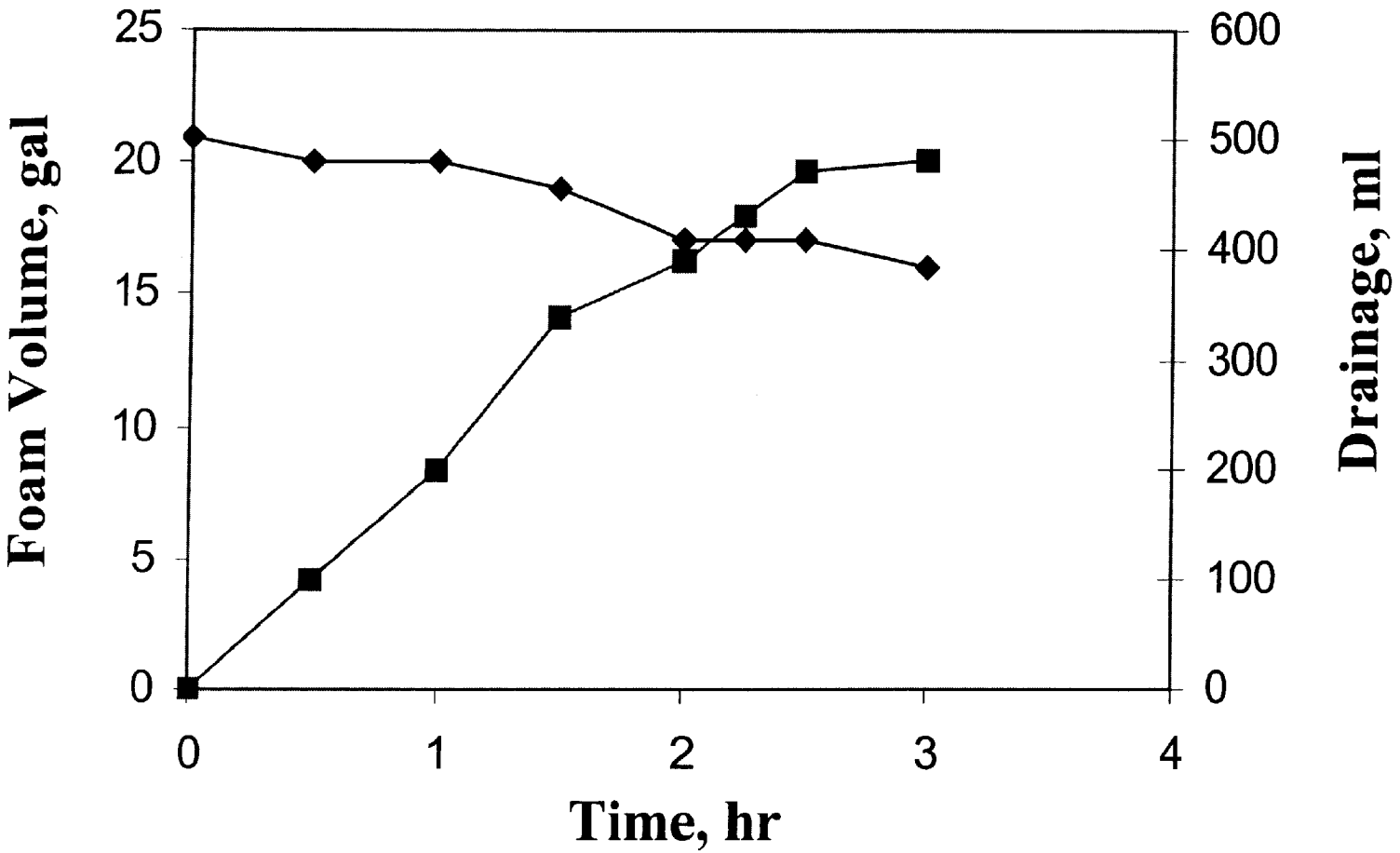
FIG. 5 shows expansion ratio and stability of a foam with hydrogen peroxide.

FIG. 4 shows the expansion ratio and stability of one embodiment of the foam of the present invention generated without hydrogen peroxide in an aspirating air foam system. This shows an expansion ratio of 125 and a half-drainage time of approximately 3 hours. FIG. 5 shows the same data with the full foam formulation (i.e., with hydrogen peroxide). In this case, the expansion ratio is 87 and the half-drainage is 2.25 hours.

Studies have been performed with the formulation of the present invention to determine the effectiveness of neutralization of CW and BW agents. Work with chemical agents focused on two general classes of agents, the nerve agents and the blistering agents. Examples of nerve agents include sarin (GB), soman (GD), tabun (GA), and VX. An example of a blistering agent is mustard (HD). Initial work was conducted with chemical agent simulants. For the G-agents, the simulant diphenylchlorophosphate was used. For VX, the simulant was malathion (o,s diethyl phenyl phosphonothioate). For mustard, the simulant was half mustard (2-chloroethylsulfide) and half 2-chloroethyl phenyl sulfide.

Live agent tests were performed at the Illinois Institute of Technology Research Institute (IITRI) and at the Edgewood Chemical Biological Center (ECBC) at the U.S. Army Aberdeen Proving Grounds, MD. Several surface tests were performed to determine the effectiveness of the foam. The general protocol for surface testing is described below:

Surface Test Procedure

1. Inoculate test coupon with a known mass of chemical agent or simulant.
2. Wait 15 minutes.
3. Apply foam to the test coupon.
4. Wait specified time period.
5. Extract the unreacted agent (or simulant) with acetonitrile.
6. Test extraction solution by gas chromatography to determine the mass of unreacted agent.
7. For the G agents and mustard, all tests are conducted at pH 8. For VX, all tests are conducted at pH 10.5 (adjusted with 3 N NaOH). This applies to both agents and simulants.

Figure 6:
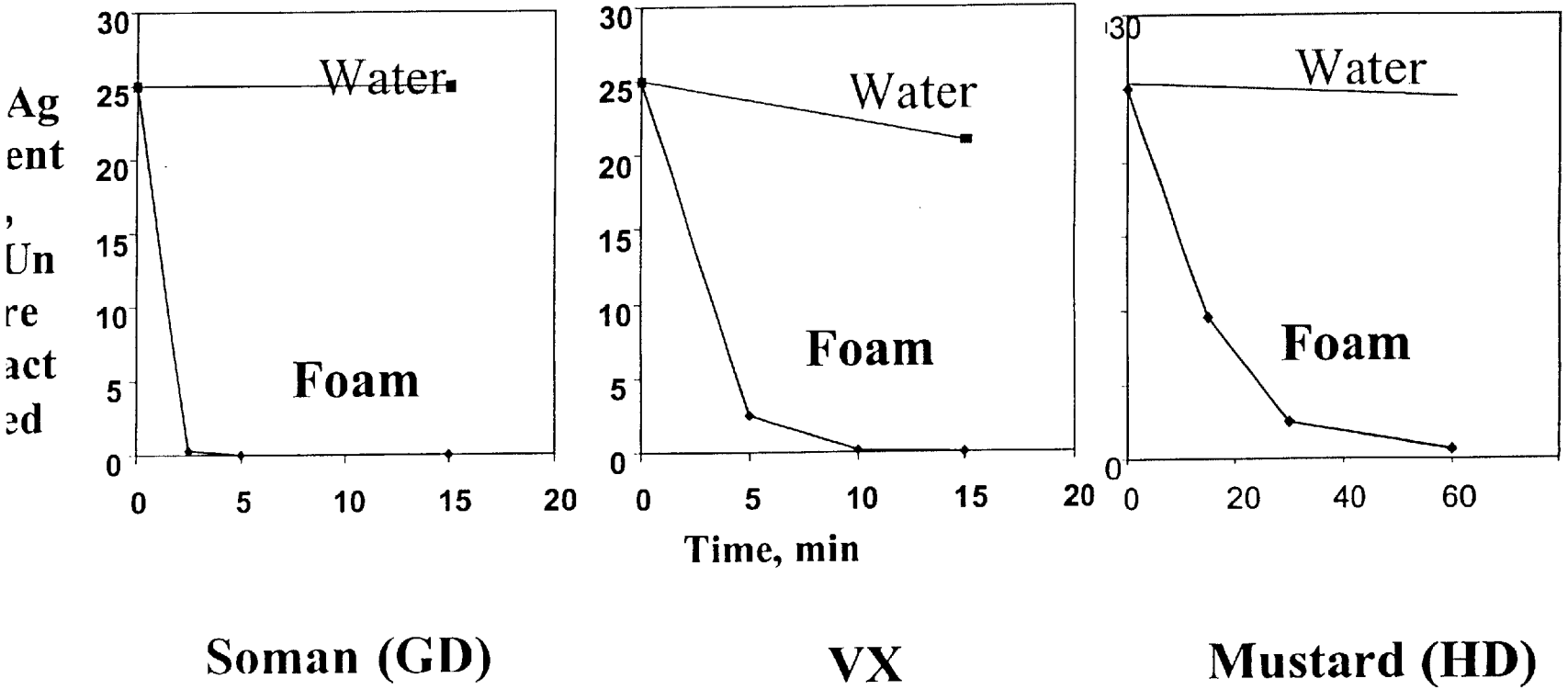
FIG. 6 shows the results of the neutralization of live agents on paper tests.

FIG. 6 shows the results of the decontamination of live agents on paper tests. Extremely rapid decontamination occurred for both soman and VX. Decontamination of mustard was slower but still extremely effective. $^{31}$P NMR studies using the VX simulant O-ethyl-S-ethyl phenylphosphonothioate demonstrated the exclusive cleavage of the P—S bond using the foam of the present invention. Therefore, the toxic product which is normally formed as a result of P—O bond cleavage in VX would not be expected to form as a result of neutralization by the foam.

Figure 7:
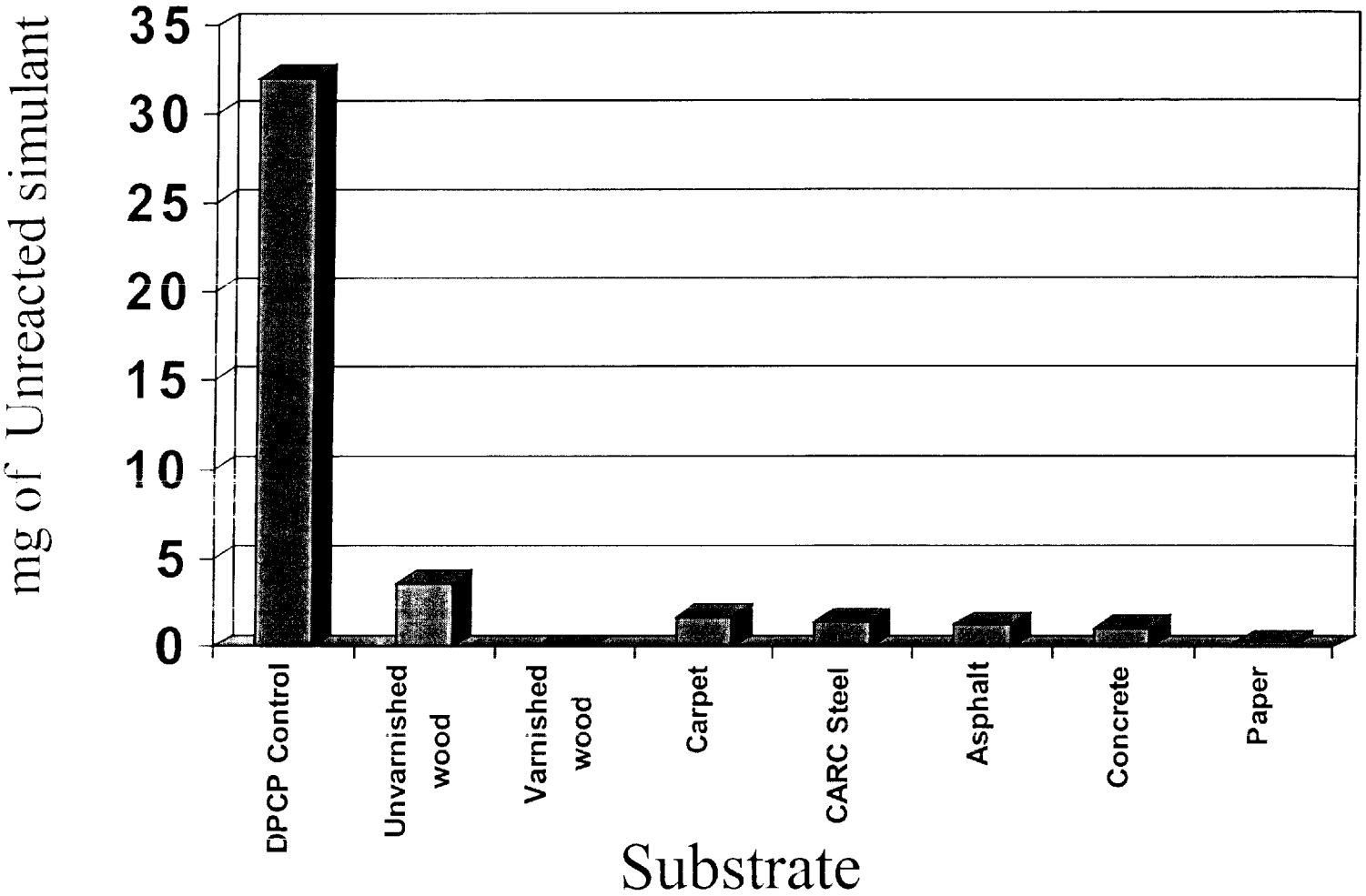
FIG. 7 shows results of tests conducted with the G agent simulant (diphenyl chlorophosphate).

The foam formulation has also been demonstrated to be effective in neutralization, in this case decontamination, on a variety of substrate surfaces (such as wood, plastic, carpeting, and concrete). Results of tests conducted with the G agent simulant (diphenyl chlorophosphate) are shown in FIG. 7. Exposure time to the foam was 15 minutes.

Figure 8:
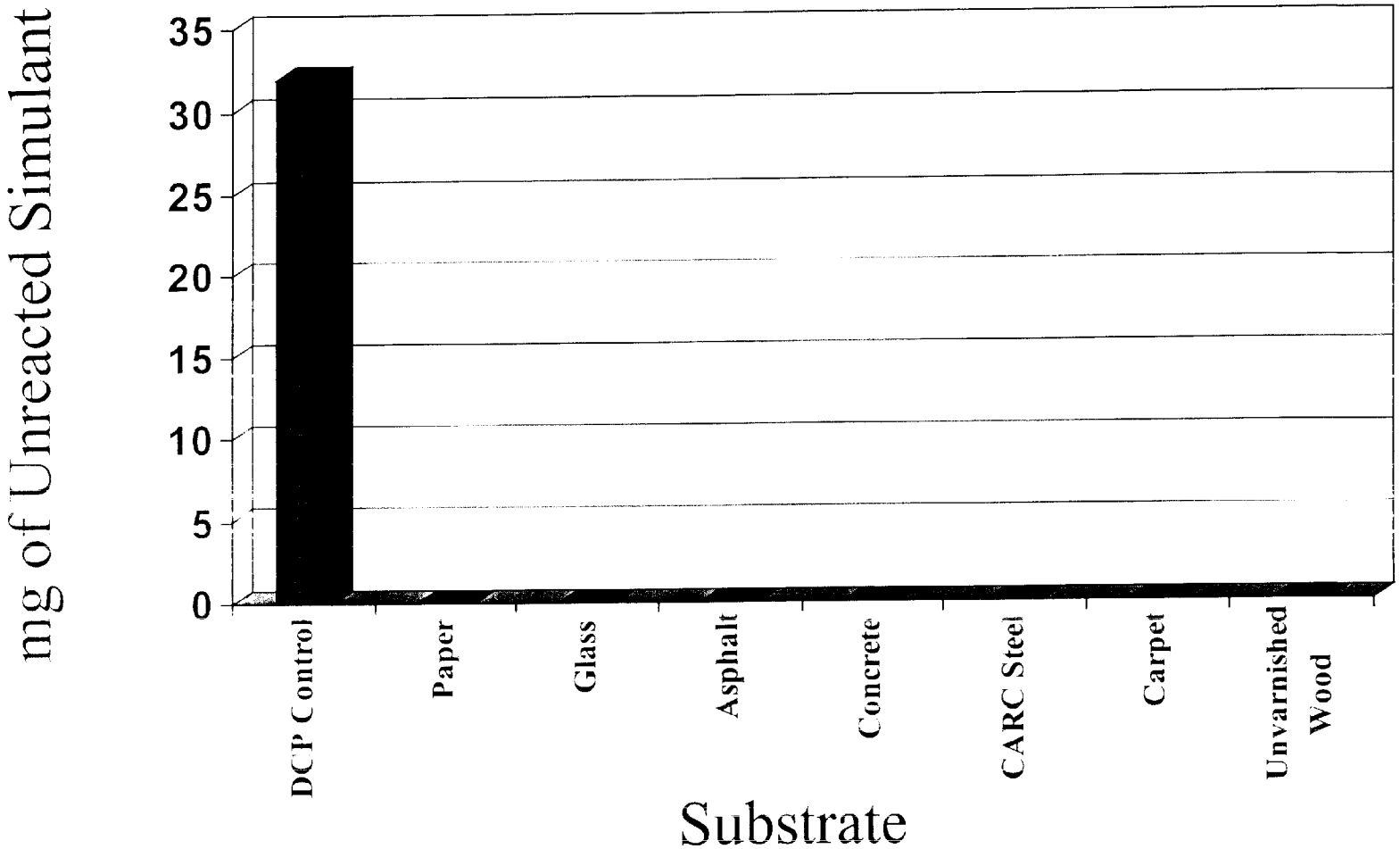
FIG. 8 shows results for the G agent simulant on a variety of surfaces.

The formulation has also been demonstrated to be effective against thickened agent simulants. Results are shown below for the G agent simulant on a variety of surfaces (FIG. 8). The simulant was thickened with 5% K125 polymer (Rohm & Haas, Inc.) K125 is an organic polymer. Polymers are often added to a pure agent solution to stabilize or protect the agent (or simulant) during deployment to minimize the impact of environmental conditions (i.e., sun, wind, rain) on the agent and to make it more effective.

Figure 9:
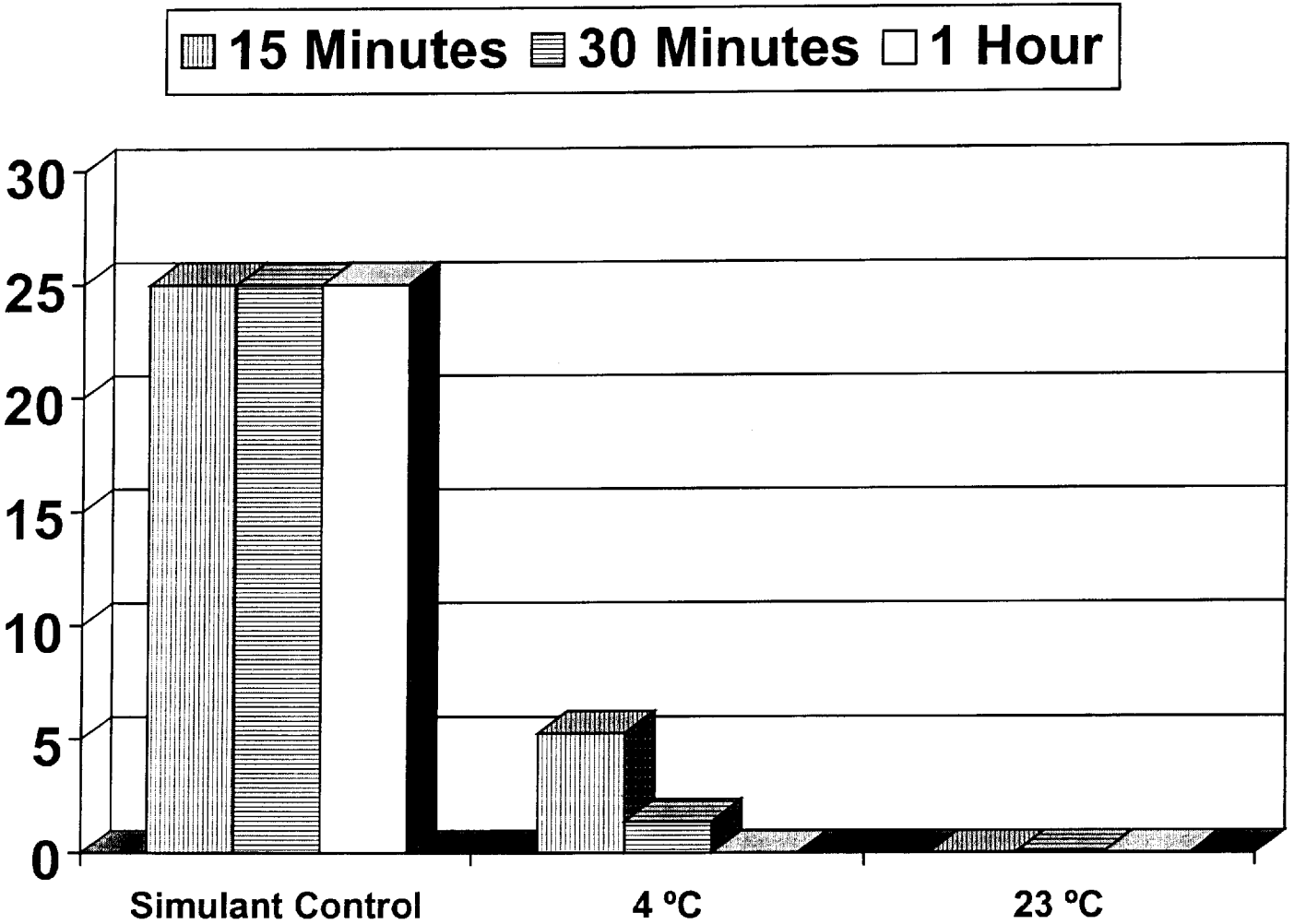
FIG. 9 show the results using a foam at different temperatures.
Figure 10:
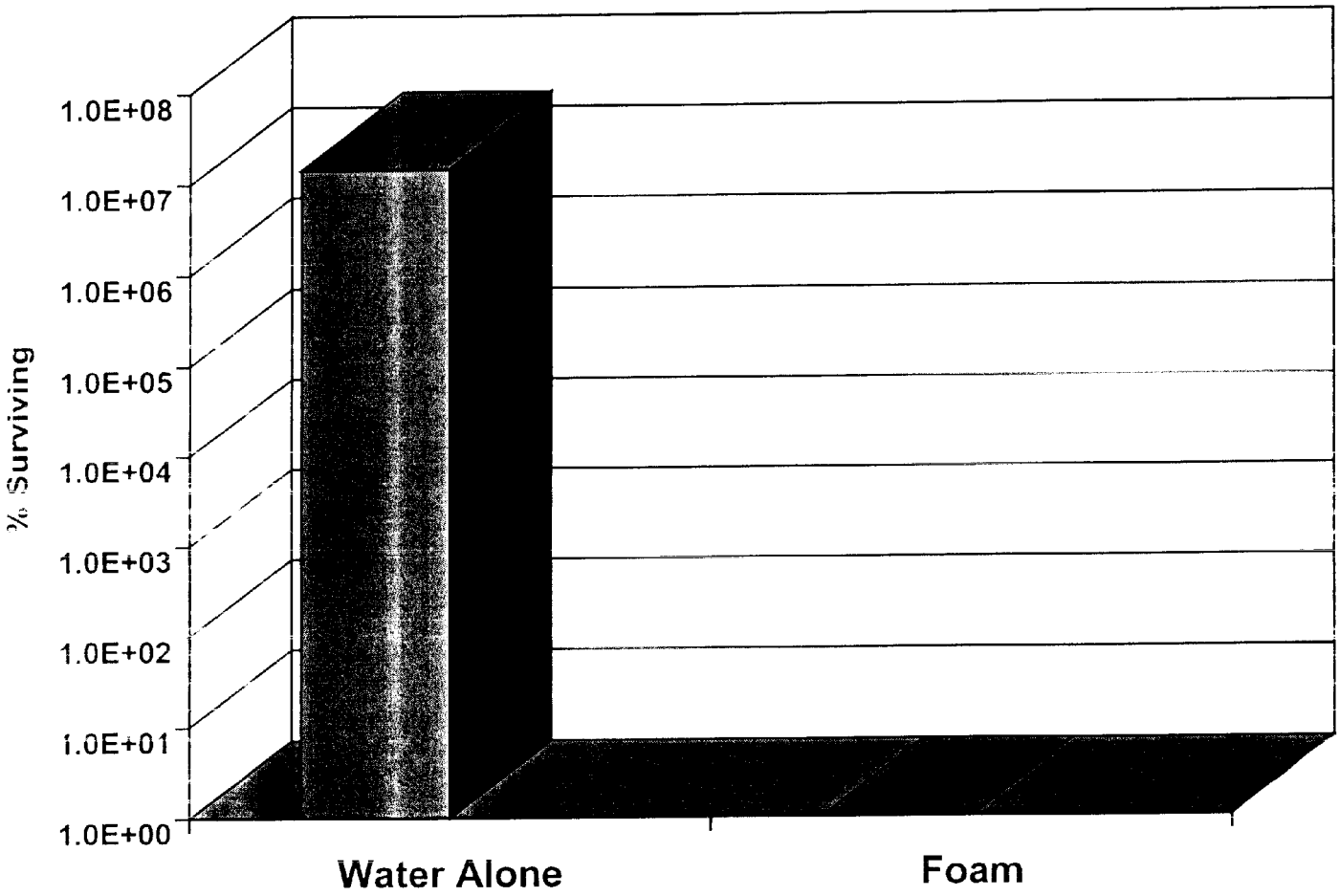
FIG. 10 shows the neutralization of *B. globigii* in solution tests.
Figure 11:
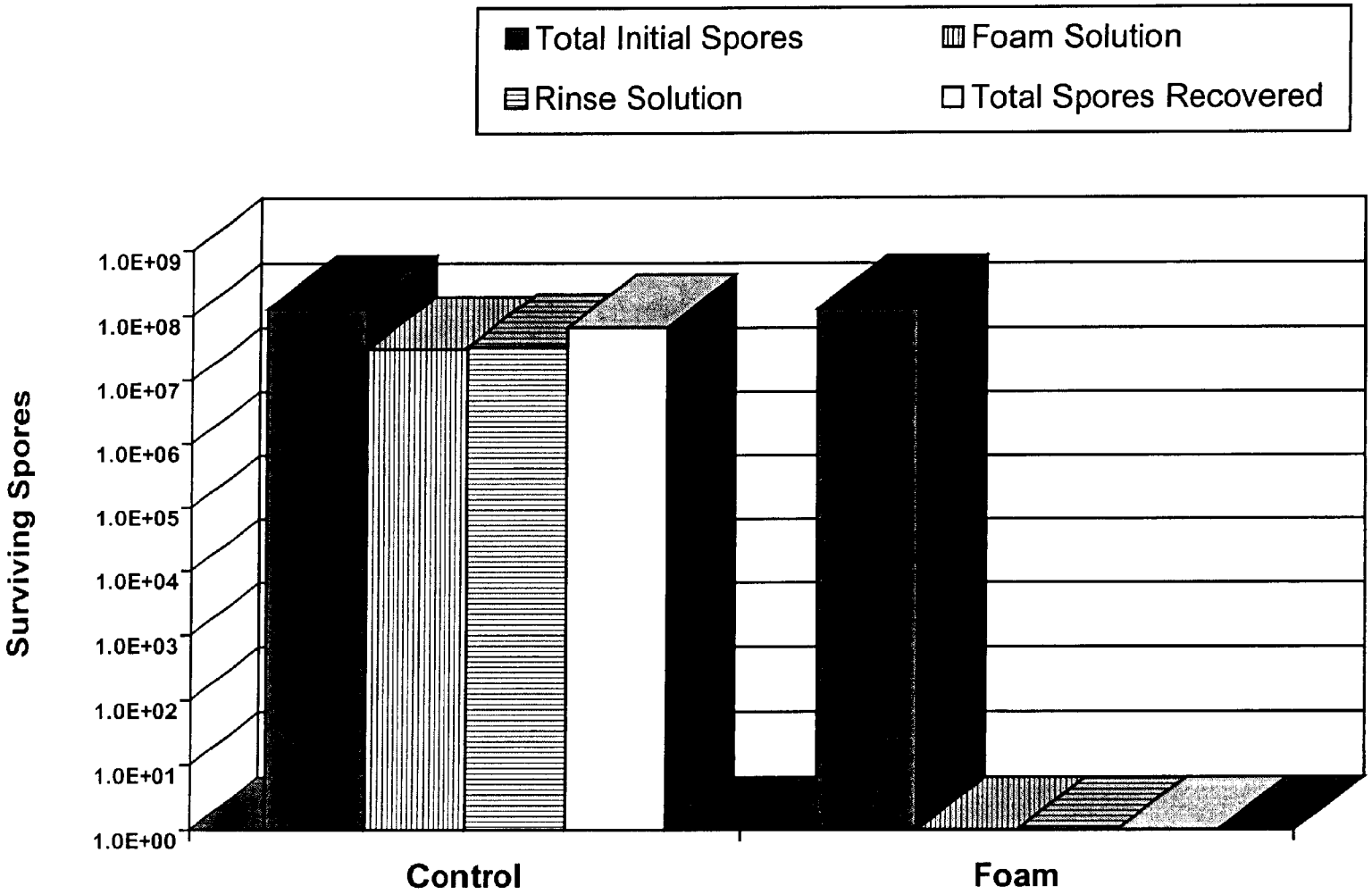
FIG. 11 shows the neutralization of *B. globigii* in surface tests.
Figure 12:
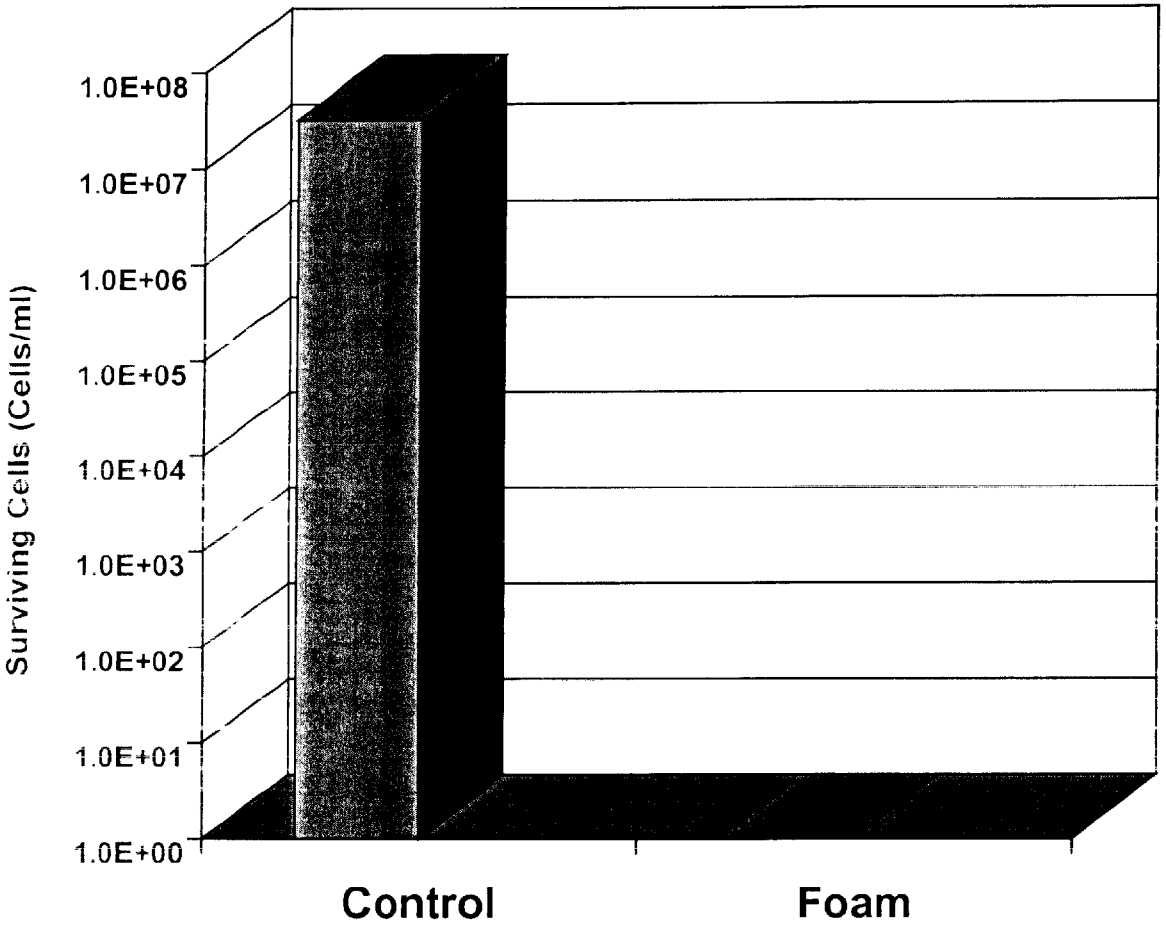
FIG. 12 shows the neutralization of *E. herbicola* vegetative cells in solution tests.
Figure 13:
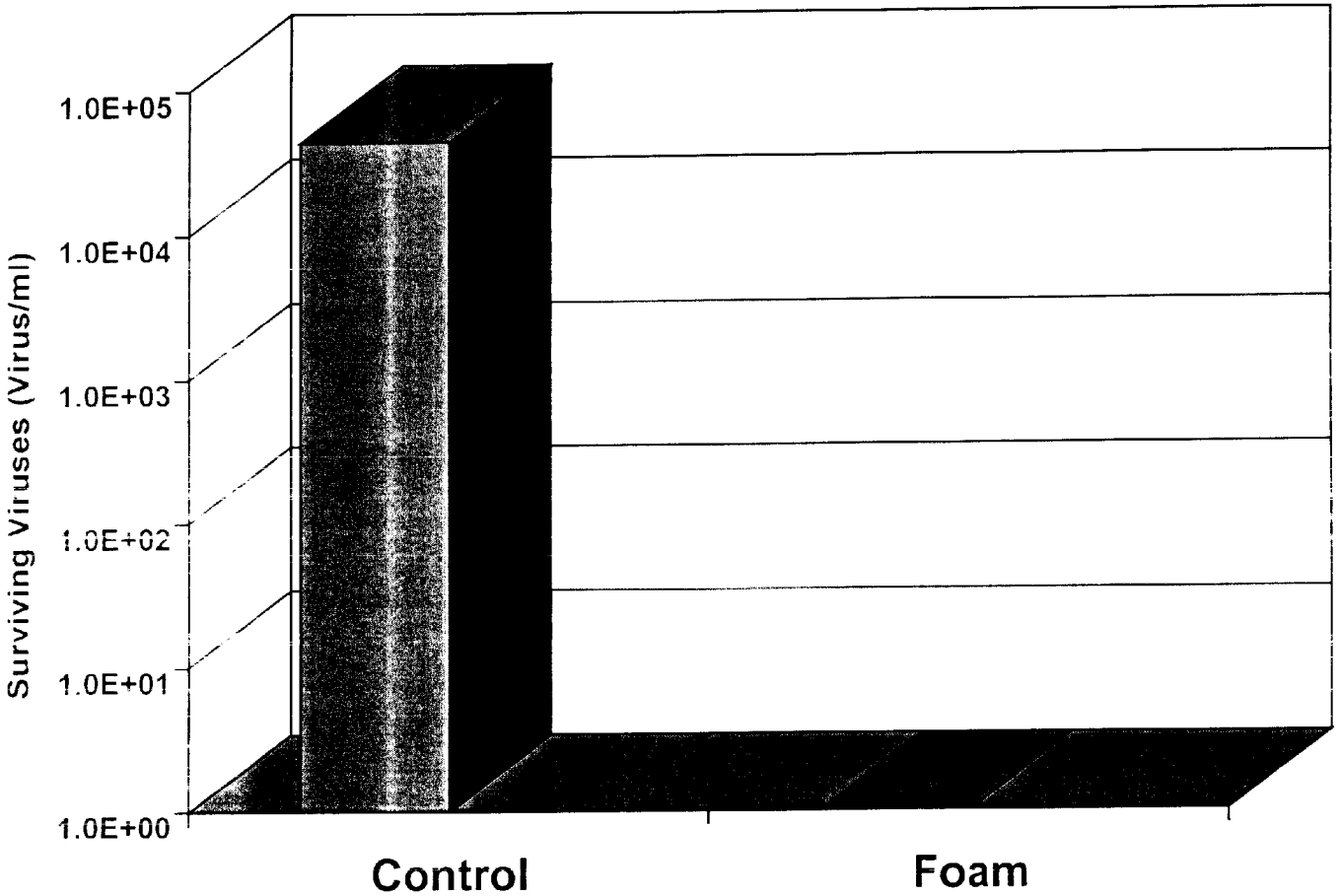
FIG. 13 shows the neutralization of MS-2 bacteriophage in solution tests.
Figure 14:
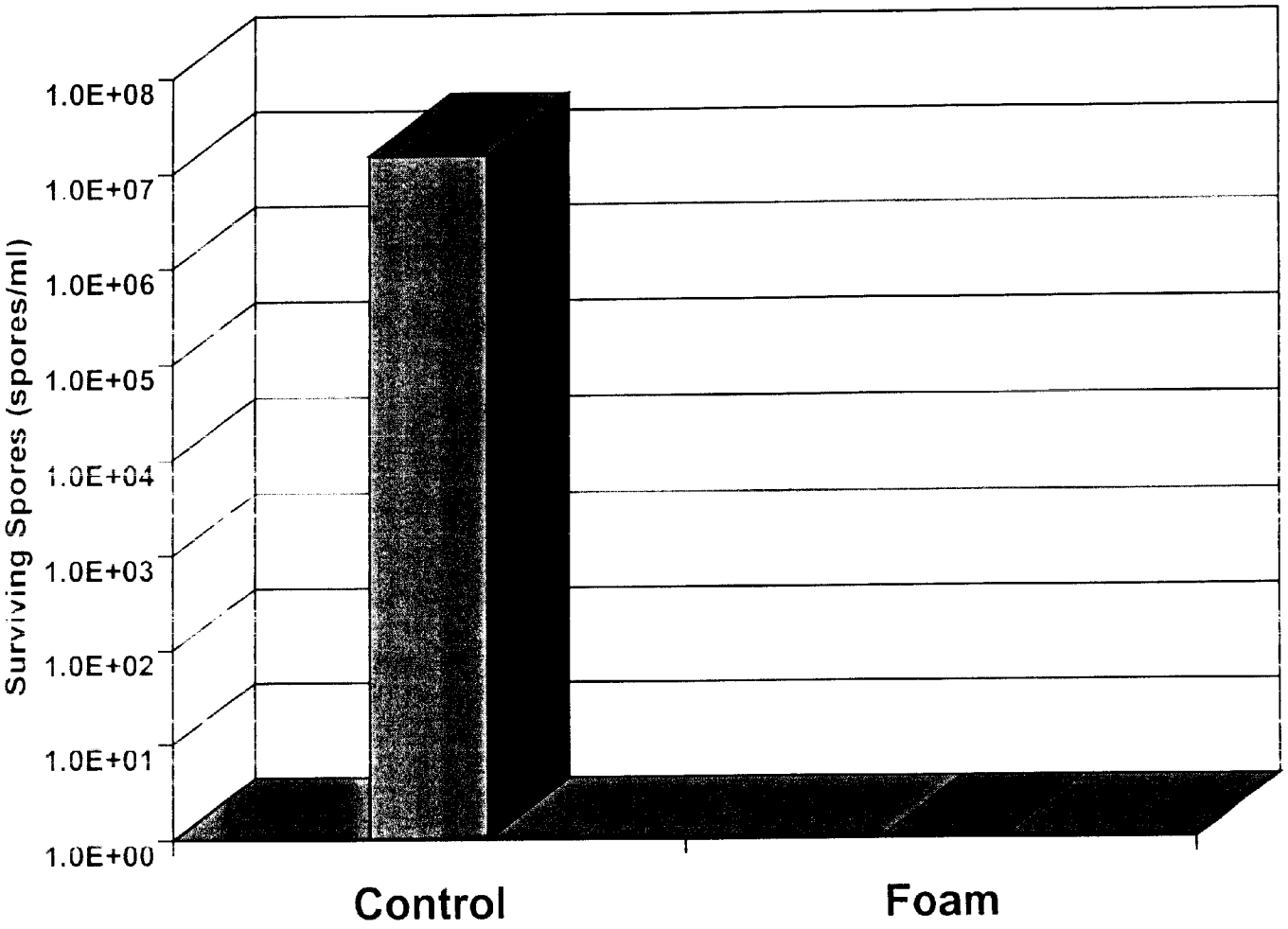
FIG. 14 shows the neutralization of *B. anthracis* spores in solution tests.
Figure 15:
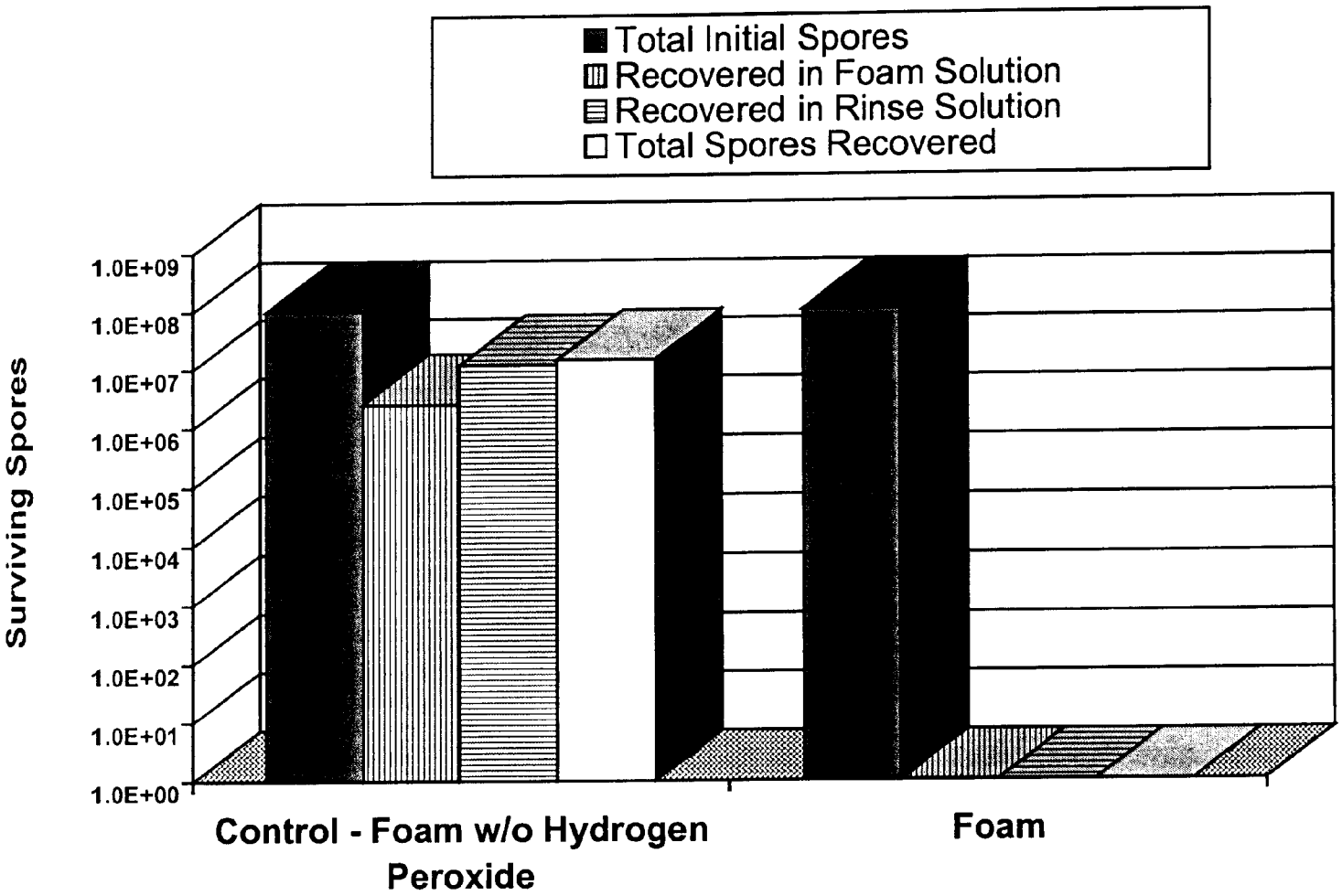
FIG. 15 shows the neutralization of *B. anthracis* spores in surface tests.

Also, tests have been conducted to assess how temperature affects the neutralization effectiveness of the foam. Neutralization of the VX simulant (o, s diethyl phenyl phosphonothioate) was evaluated at 4° C. and 23° C. (room temperature). Results, shown in FIG. 9, demonstrate that the foam is effective (although slower) even at low temperatures.

Live agent tests were conducted at ECBC. Two types of live agent tests also performed were kinetic (or reaction rate) tests and contact hazard tests. The following test procedures were used.

Procedure for ECBC Reaction Rate Test

1. All tests were conducted with CASARM-grade agents (Chemical Agent Standard Analytical Reference Material).
2. Additions of hydrogen peroxide to the neutralization test solutions were made on the day of the tests.
3. All tests were conducted in a stirred, jacketed reaction vessel maintained at 25° C.
4. The neutralization solution (100 ml) was placed in the reaction vessel and mixed for a sufficient period of time to allow for equilibration (in the case of the foam—the test was performed with the liquid used to generate the foam, not the foamed material).
5. For the foam, tests for GD and HD were conducted at pH 8. For VX, the tests were conducted at pH 10.5 (adjusted with 3 N NaOH).
6. At the start of the test, 2 ml of the agent was placed into the reaction vessel.
7. At measured intervals (10 minutes and one hour), samples were removed from the reaction vessel. The samples were quenched with solvent and analyzed by gas chromatography mass spectrometry (GC MS) for unreacted agent.
8. All test samples were analyzed in triplicate.

Procedure for the ECBC Contact Hazard Test

1. All agents were CASARM-grade. All tests were conducted at ambient room temperature (23° C.).
2. The following test coupons were used:
   a. Chemical Agent Resistant Coating (CARC)—MIL-C-53039A, Polyurethane Topcoat with Primer MIL-P-53022B epoxy.
   b. Navy Non-Skid Paint—MIL-C-24667A.
   c. Aircraft (AC) Topcoat MIL-PRF-85285C
   d. Navy Alkyd Paint DOD-E-24634, color 26270 (haze gray)
3. A border was drawn on all test coupons with a black grease pencil.
4. Each test coupon (positioned horizontally), was contaminated with 2 $\mu$L drops of VX, TGD (thickened GD), or HD at a density of 1 mg/cm$^2$.
5. The agent was covered with a glass dish for one hour to prevent evaporation.
6. Fresh neutralization formulation was mixed immediately prior to use.
7. The contaminated coupons were then treated with 1 mg of neutralizing agent for 15 minutes (in the case of the foam—the test was performed with the liquid used to generate the foam, not the foamed material).
8. After 15 minutes, the neutralizing agent was rinsed from the contaminated coupons (front and back) with de-ionized/distilled water (37 ml) with a laboratory pump. The pump delivered 30 ml/min.
9. The coupons were air dried for 2 minutes after which a 20 cm$^2$ piece of dental dam was placed over the contaminated area. A 1 kg weight was placed on top of the dental dam.
10. After a contact time of 15 minutes, agent on the dental dam was extracted in 18 ml of chloroform for 15 minutes.
11. The unreacted agent in the extraction solvent was analyzed by GC.

Results from the reaction rate tests indicating the weight percent of chemical toxant neutralized are shown below. The results are compared to DS2.

| | HD | | GD | | VX | |
|---|---|---|---|---|---|---|
| Neutralizing Agent | 10 min | 1 hour | 10 min | 1 hour | 10 min | 1 hour |
| DS2 | 100 | 100 | 100 | 100 | 100 | 100 |
| Foam | 47 | 100 | >99 | 100 | 100 | 100 |

The results from these tests clearly indicate that the foam of the present invention is very effective in the neutralization of CW agents. It is also clear that DS2 is a very effective decontamination solution and that the primary motivation for finding a replacement is due to it's high toxicity and high corrosivity not it's inability to decontaminate CW agents.

One issue about the foam formulation concerns the use of the foam by first responders vs. personnel involved in facility restoration. When used for facility restoration, the exact chemical or biological agent that has been used will most likely be known. In that case, the pH of the formulation may be easily adjusted to the optimum value for that specific agent. This pH adjustment can be accomplished through the use of pre-measured packets in which a base (such as NaOH) will be included with the solid hydrogen peroxide and will be added to the liquid foam formulation immediately before use. The formulation will function at pH values of approximately 5 to approximately 12. The optimum pH values for neutralization of various CW and BW agents using the formulation of the present invention are generally between approximately 8 and 11. However, for first responders, the specific agent will be, in general, unknown. Therefore an intermediate pH must be selected that will effectively react with all agents. This intermediate pH value will be, by necessity, a compromise. A suitable pH for first responder use was found to be approximately 9. Neutralization effectiveness of the foam against various CBW agents and simulants is summarized in the table below, showing the percent of the agent or simulant neutralized for various exposure times. (In summary, neutralization of CBW agents that have been tested can be achieved in a period of approximately 2–60 minutes depending on the agent.

| Agent/ Simulant | Time | pH 7.0 | pH 8.0 | pH 9.2 | pH 10.5 |
|---|---|---|---|---|---|
| Anthrax | 30 min. | 99.99 | 99.99 | — | — |
| spores | 1 hour | 99.99999 | 99.99999 | — | — |
| Anthrax | 30 min. | 99.99 | 99.99 | 99 | — |
| simulant | 1 hour | 99.99999 | 99.99999 | 99.99 | — |
| (*B. globigii* spores) | | | | | |
| GD | 10 min. | — | 100 | >99 | — |
| | 1 hour | — | 100 | 100 | — |
| VX | 10 min. | — | — | | 100 |
| | 1 hour | — | — | | 100 |
| VX Simulant | 15 min. | — | 18 | 70 | 100 |
| | 30 min. | — | 38 | | 100 |
| | 1 hour | — | — | 99.5 | 100 |
| HD | 10 min. | — | 48 | 47 | — |
| | 1 hour | — | 98 | 100 | — |

Work with biological agents has been focused on what is perceived to be the most difficult of agents to kill, bacterial spores (e.g., *Bacillus anthracis* or anthrax). Numerous tests have been conducted with the spore-forming bacterium *Bacillus globigii* (a recognized simulant for anthrax) to determine the effectiveness of the foam formulation of the present invention in neutralizing (killing) this microorganism. Tests have also been conducted to determine the killing efficiency of the foam on a simulant for plague (*Erwinia herbicola*—a vegetative bacterial cell) and on a simulant for the smallpox virus (the MS-2 bacteriophage). In addition, live agent testing has been conducted with *Bacillus anthracis* ANR-1 at the Illinois Institute of Technology Research Institute in Chicago, Ill. The foam has been shown to be effective in killing all of these organisms in a timely manner.

Two basic types of tests have been conducted to test the foam's effectiveness in the killing of BW simulants and agents. In the first type of test, a solution test, the microorganisms were dispensed directly into the liquid solution from which the foam is generated. After specified periods of time, the microorganisms were extracted from the solution by centrifugation, washed, and then plated on an appropriate biological medium to determine if they had been killed. The general test protocol for solution tests using spores and vegetative cells is given below. Microorganisms used for the spore tests were *Bacillus globigii* (ATCC 9372) and *Bacillus anthracis* ANR-1. The microorganism used for the vegetative cell tests was *Erwinia herbicola* (ATCC 39368). The MS-2 bacteriophage (ATCC 15597B) with the bacterial host *Escherichia coli* (ATCC 15597) were used for the viral inactivation tests.

Protocol for Solution Tests

1. Prepare a suspension of washed microorganisms in sterile de-ionized water. The population should be approximately $5\times10^7$ microbes/ml.
2. Add 5 ml of microorganism suspension to each of 12 centrifuge tubes. Centrifuge the tubes for 15 minutes to pellet the microbes. Discard the supernatant.
3. Add 5 ml of the test solution at 25° C. to each tube.
4. Re-suspend the microorganisms in the test solutions.
5. After the specified contact time (15 minutes, 30 minutes or 1 hour), dilute the test solutions by a factor of ten with sterile de-ionized water and centrifuge for thirty minutes to pellet the microorganisms.
6. Discard the supernatant and re-suspend the microorganisms in 15 ml of sterile de-ionized water.
7. Repeat the washing step two additional times. After the final wash, re-suspend the microorganisms in 5 ml of fresh sterile nutrient broth.
8. Plate each test solution and the original microbe suspension solution on Brain Heart Infusion Agar (for *Bacillus globigii* and *Bacillus anthracis*) or Nutrient Agar (for *Erwinia herbicola*) at $10^0$–$10^{-7}$ serial dilutions and incubate at 37° C. for 48 hours.
9. Count the plates to determine the kill efficiency for each test solution.

Protocol for Virus Solution Tests

1. Grow a culture of *E. coli* for 18 hours in tryptic soy broth at 37° C.
2. Inoculate fresh tryptic soy broth with cultured *E. coli*. Incubate this inoculum for 3–6 hours at 37° C. with continuous shaking.
3. Add stock MS-2 to the following test solutions:
   a. sterile de-ionized water
   b. foam formulation
4. After one hour, dilute the test solutions by a factor of ten with sterile, de-ionized water. Centrifuge and discard the supernatant. Re-suspend the pellet in 5 ml of sterile Tris buffer at pH 7.3.
5. Serially dilute the phage suspensions in a $10^0$–$10-^7$ dilution series.
6. To tubes of molten overlay agar (tryptic soy broth with 1% agar), add 0.1 ml of phage suspension and 1 ml of *E. coli* culture. Mix and pour onto tryptic soy agar plates.
7. After 18–24 hours of incubation at 37° C., count the plaque-forming units on the tryptic soy agar plates.

Surface tests were conducted only for spore kill (both for *Bacillus globigii* and *Bacillus anthracis*). This protocol is also given below:

Protocol for Surface Tests

1. Prepare a suspension of washed spores in sterile de-ionized water to give approximately $5\times10^8$ spores/ml.
2. Evenly deposit 0.2 ml of the spore suspension on nine frosted glass slides (22 mm×30 mm) and air dry under aseptic conditions for 24 hours.

3. Place six of the glass slides in separate sterile 400 ml glass beakers.
4. Place 100 ml of the following test solutions in separate sterile 250 ml glass beakers:
   a. foam (with no hydrogen peroxide)
   b. foam+4% hydrogen peroxide
5. Bubble ultra high-purity air through a test solution to create foam. Allow the foam to flow into a beaker containing a glass slide until the foam reaches approximately ½ inch below the top of the beaker. Cover the beaker with a sterile lid and wait one hour. Repeat this step until 3 glass slides are exposed to Test Solution "a" and three are exposed to test Solution "b".
6. After one hour of exposure time, aseptically remove a glass slide from a 400 ml beaker and place it into a 250 ml beaker containing 50 ml of sterile, de-ionized water (i.e., the rinse solution) with a stir bar. Stir for two hours at medium speed. Repeat this step for all slides that have been exposed to a test solution (i.e., a total of six slides).
7. Place the three untreated glass slides (control) into a 250 ml beaker containing 50 ml of sterile de-ionized water and stir for two hours.
8. Immediately collect the collapsed foam solution from each 400 ml test beaker with a sterile 10 ml pipet. Record the volume of foam solution collected. Place the collected foam solution into a centrifuge tube and dilute by a factor of ten with sterile de-ionized water. Centrifuge for thirty minutes.
9. Carefully draw off the liquid and re-suspend the spores in 15 ml of sterile de-ionized water. Repeat the washing steps two additional times. On the final wash, re-suspend the spores in 5 ml of fresh sterile nutrient broth.
10. Plate the spores recovered from the foam solution (after the washing steps) on Brain Heart Infusion Agar at $10^0$–$10^{-7}$ serial dilutions and incubate at 37° C. for 48 hours.
11. Plate the spores in the rinse solution on Brain Heart Infusion Agar (or the appropriate media for anthrax) at $10^0$–$10^{-7}$ serial dilutions and incubate at 37° C. for 48 hours.
12. Count the plates and calculate total number of spores recovered.
13. Plate the original spore suspension solution on Brain Heart Infusion Agar (or the appropriate media for anthrax) at $10^0$–$10^{-7}$ serial dilutions and incubate at 37° C. for 48 hours.
14. Count the plates and calculate total number of spores originally placed on the glass slides.

All tests were conducted under aseptic conditions to minimize potential of contamination by indigenous microorganisms. Controls were run to confirm the presence of aseptic conditions during the experiments. Hydrogen peroxide was added to the foam solution immediately before the start of a test. The pH of the final foam formulation (foam+4% hydrogen peroxide) was 8.0. All tests were performed in triplicate. The results from these tests were as follows:

complete kill ( defined as 7 Log kill or killing 99.99999% of the originally present biological components) of *B. globigii* and *B. anthracis* spores were obtained after one hour exposure to the foam in both solution and surface tests complete kill (7 Log) of the *E. herbicola* cells was obtained after 15 minutes in solution tests complete deactivation (4 Log) of the MS-2 bacteriophage was obtained after 60 minutes exposure to the foam solution (note: 60 minutes was the only time period tested)

The results of each of these tests is shown in FIGS. 10–15.

In addition to -the tests described above, various components of the foam were tested individually to determine their effect on spore kill. In solution tests, *Bacillus globigii* spores were exposed to the following components from the foam formulation.

de-ionized water (control).

3% cationic surfactant in de-ionized water.

3.8% cationic hydrotrope in de-ionized water.

2% alcohol mix (36.4% iso-butanol, 56.4% diethylene glycol monobutyl ether, and 7.3% 1-dodecanol) in de-ionized water.

4% hydrogen peroxide and 4% sodium bicarbonate in de-ionized water.

2% alcohol mix, 4% hydrogen peroxide, and 4% sodium bicarbonate in de-ionized water.

3% cationic surfactant and 4% hydrogen peroxide in de-ionized water.

3.8% cationic hydrotrope, 4% hydrogen peroxide, and 4% sodium bicarbonate in de-ionized water.

3% cationic surfactant, 4% hydrogen peroxide and 4% sodium bicarbonate in de-ionized water.

Figure 16:
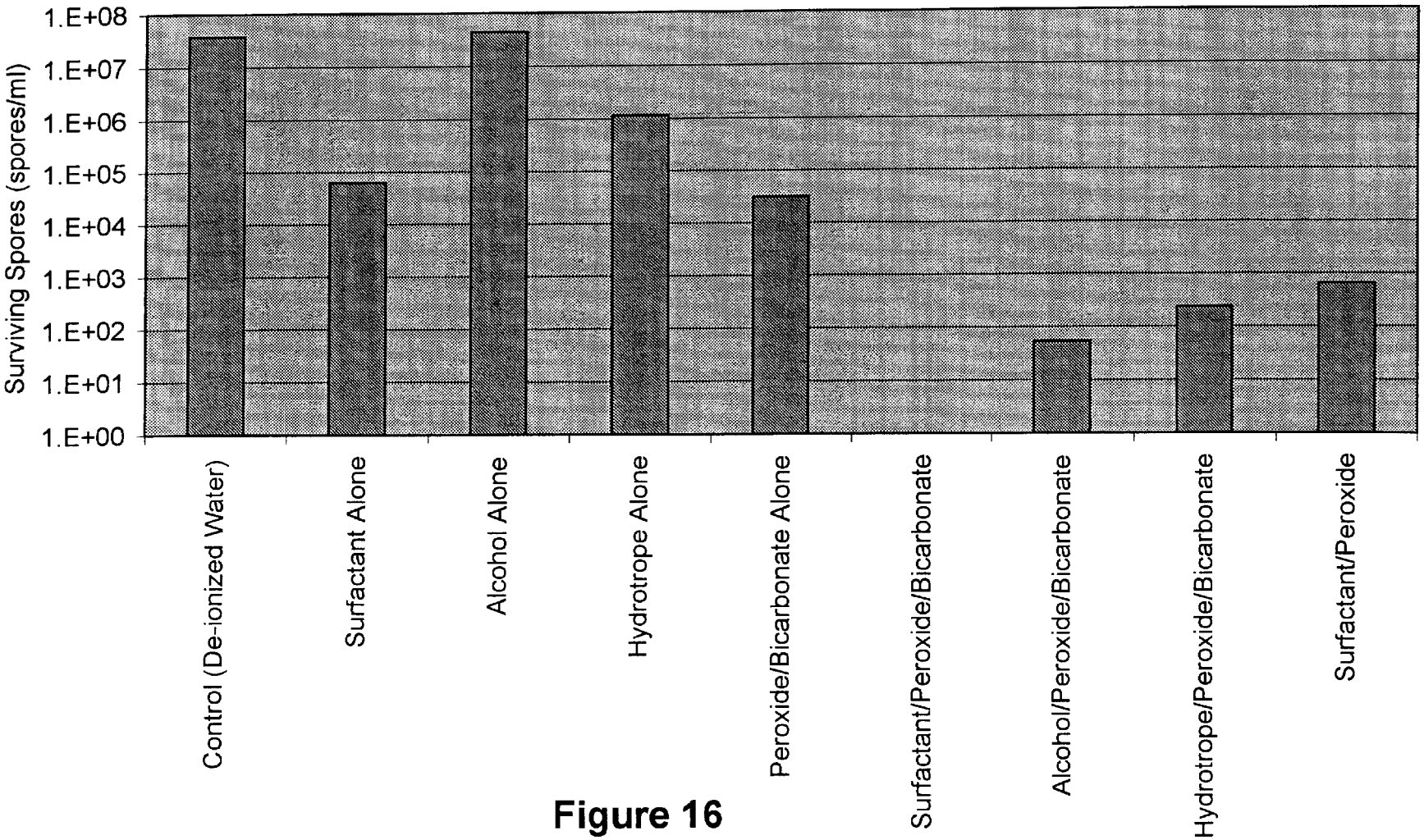
FIG. 16 shows the neutralization of the anthrax surrogate, *B. globigii.*

The results for these tests are shown in FIG. 16. The results clearly show a synergism between the cationic surfactant, the hydrogen peroxide, and the sodium bicarbonate, which accounts for the dramatic sporicidal effect of the foam formulation of the present invention.

An additional compound can be added to the foam formulation of the present invention to aid in inhibiting corrosion of metal to which the foam could be exposed. In one embodiment, dimethyl ethanolamine was added and inhibited corrosion of the steel substrate without detracting from the detoxification of the CW simulants; the compound could have actually enhanced the chemical deactivation as ethanolamine is known to catalyze the hydrolysis reaction of certain CW agents such as G-agents. The range for the addition of dimethyl ethanolamine is from 0.1 to 10%. Other potential corrosion inhibitors include triethanolamine, ethanolamine salts of C9, C10 and C12 diacid mixtures, dicyclohexyl amine nitrite, and N,N-dibenzylamine.

The foam formulation of the present invention has been successfully deployed by small fire extinguisher-type units pressurized by $CO_2$ cartridges, by hand-held units which are pressurized by a connection to a fire hydrant, and by large military-style pumps. Each of these foam-generating units uses a foam nozzle which draws air into the foam through a Venturi effect. There is no need to supply air to the foam nozzle, the foam is generated through the use of room air. This is important because a supplied-air foam generator will add air to the room where foam is being produced, pushing the existing air away (outside of the room) and causing the migration of chemical and biological agents.

The foam has also been successfully generated through compressed air foam systems. In these systems, air is directly injected into the liquid stream before the liquid leaves the foam nozzle.

Another important issue concerning foam deployment is clean-up of the foam after it has been generated and has achieved decontamination of the CW and BW agents. Although the foam is highly stable, it can be broken down very easily with the use of commercially-available de-foamers. After deployment of the foam and a sufficient period of time for decontamination of the agents, the foam can be removed with a water spray containing a low concentration (1–2%) of the de-foamer. This process returns the foam to a liquid state.

Alternative deployment methods for the foam formulation are also available with the formulation of the present invention. Foam is nothing more than a liquid solution with a gas phase (in this case, air) blown through it. It is the formulation that is effective in the destruction/neutralization of the CBW agents, not the foam (in other words, the liquid formulation decontaminates CBW agents, not the air). Therefore, alternative methods such as sprays, mists, and fogs can be utilized with the same basic formulation. The objective of these alternative methods will be to minimize the quantity of water that is required to be used in the restoration of controlled environments (such as indoor facilities) and to facilitate access of the formulation to the CBW agents.

These alternative deployment methods can have various advantages over foam deployment. A fog, for example, can be used to achieve effective decontamination in areas where decontamination by a foam would be difficult, if not impossible. One example is the interior of air conditioning ducts. A fog could be generated at registers and other openings in the duct and travel a significant distance inside of the duct to decontaminate hard to reach places. An additional advantage of a fog is that a relatively automated decontamination system could be set-up at the scene of an attack. Remotely activated foggers could be placed inside of a facility and turned on at periodic intervals (from a remote location) to completely decontaminate the facility. This method would greatly decrease the potential for decontamination personnel to be exposed to a CBW agent.

In one embodiment, the formulation of the present invention is an aqueous-based formulation that is capable of being deployed as a fog (i.e., as an aerosol with particulate sizes ranging from 1–30 microns) for the rapid neutralization of chemical and biological warfare (CBW) agents. The formulation exhibits low-corrosivity and low-toxicity properties and can be deployed through commercially-available fog generating devices. The formulation consists of cationic surfactants and cationic hydrotropes in combination with low concentrations of hydrogen peroxide and a bicarbonate salt (e.g., sodium, potassium, or ammonium bicarbonate). Current decontamination formulations utilize toxic and/or corrosive chemicals to achieve destruction of CBW agents which can potentially damage sensitive equipment in which it comes into contact. In addition, most current formulations require large amounts of water for decontamination.

The formulation contains similar constituents as the aqueous foam formulation. However, various constituents only necessary for foaming have been removed from the foam formulation. The formulation of the aqueous-based fog solution is as follows:

| Compound | Range of Concentration (wt. % of overall formulation) |
|---|---|
| cationic surfactant | 0.1–20 |
| cationic hydrotrope | 0.1–40 |
| hydrogen peroxide | 0–5 |
| bicarbonate salt | 0–10 |
| water | 25–96.8 |

Cationic surfactants are typically quaternary ammonium salts such as cetyltrimethyl ammonium bromide. Other examples of cationic surfactants include polymeric quaternary compounds. Examples of suitable hydrotropes are tetrapentyl ammonium bromide, triacetyl methyl ammonium bromide, and tetrabutyl ammonium bromide. The combination of bicarbonate and hydrogen peroxide forms an oxidizer (the highly reactive hydroperoxycarbonate species) and is a significant contributor to the neutralization of CBW agents.

In one test to demonstrate neutralization of a chemical agent, 25 microliters (~20 mg) of a chemical agent simulant (diphenyl chloro phosphate) was placed on -a test coupon (carpet, metal, wood, etc.). The coupon was placed inside of a test chamber that was then filled with the fog formulation generated from a commercial fogging device (droplet sizes between 1–20 microns). The same simulant was placed on identical test coupons to serve as an experimental control. After one hour, the control and experimental test coupons were placed in a solution of acetronitrile for one hour to extract unreacted simulant. The acetonitrile solution was then analyzed by gas chromatography to determine the mass of unreacted simulant. Greater than 99% neutralization of the G agent simulant (diphenyl chloro phosphate) was achieved after one hour exposure to the fog in a test chamber on all surfaces tested and complete neutralization was achieved after four successive fog treatments (with a one hour wait between each treatment) for all surfaces. Between 70% and 99% neutralization was achieved after four successive foggings of the VX simulant (O-ethyl-S-ethyl phenyl phosphonothioate) and between 30% and 85% neutralization was achieved with the mustard simulant (chloroethyl ethylsulfide) after four successive foggings. For the anthrax simulant (*B. globigii* spores), 7 Log kill was achieved after four successive foggings.

One difference of this formulation over existing fogging solutions for decontamination of CBW agents is that it is aqueous-based. Current fogging solutions for CBW decontamination are organic liquids. This formulation has low toxicity and low corrosivity properties. This allows the formulation to be used where exposure to people, animals, or equipment may be necessary or prudent.

The following two examples describe how to make two foam formulations according to the present invention. Thereafter, examples of testing results obtained using foams made according to the principles of the claimed invention are presented. Although the sequence of steps indicated in Example 1 and Example 2 represent preferred embodiments of the invention, the specific sequences described here are not necessarily required in order to accomplish the objectives of the invention.

EXAMPLE 1

Combine the Following in 100 ml of Water

- 3.84 wt. % WITCO ADOGEN 477™ (50%)—Cationic hydrotrope
- 2.0 wt. % Alcohol mix (36.4 wt. % isobutanol, 56.4 wt. % diethyleneglycolmonobutyl ether, 7.3 wt. % $C_{12-14}$, blend of dodecanol/tetradeconol)—Long chain fatty alcohol
- 0.2 wt. % JAGUAR 8000™ polymer—Water soluble polymer
- Hydrochloric acid (to adjust pH to approximately 6.5 in order to enhance dissolution of the polymer)

EXAMPLE 2

Combine the Following in 100 ml Water in the Order Shown

- 3.84 wt. % WITCO ADOGEN 477™ (50%)—Cationic hydrotrope
- 2.0 wt. % Alcohol mix (36.4 wt. % isobutanol, 56.4 wt. % diethyleneglycolmonobutyl ether, 7.3 wt. % dodecanol)—Long chain fatty alcohol
- 0.2 wt. % JAGUAR 8000™ polymer—Water soluble polymer Hydrochloric acid (to adjust pH to approximately 6.5)—May serve to activate the polymer and cause the mixture to attain desired viscosity 3 wt. % WITCO VARIQUA™ 80 MC—Cationic surfactant that may solubilize the chemical agents 1.5 wt. % 1:1 Dodecanol and diethyleneglycolmonobutyl ether—Helps stabilize the foam 2.0 wt. % Hydrogen peroxide 2.0 wt. % Sodium bicarbonate ($NaHCO_3$)—The hydrogen peroxide and sodium bicarbonate together serve as a strong nucleophile.

The following summary of results and data is based on tests performed using standard simulants for CW agents. Due to the high toxicity of actual (live) agents, simulants are selected to mimic both the chemical and physical properties of actual CW agents. For example, diphenyl chlorophosphate is a liquid, sparingly soluble in water that is chemically similar to G-agents. Malathion is another simulant often substituted for VX chemical agents in laboratory testing and development.

CW Simulants

1. Testing Protocol 25 mg of simulant were spread on a 25 $cm^2$ on a 25 $cm^2$ surface, i.e., 10 $g/m^2$ (regular printer paper and soda-lime glass surfaces were used) foam was applied on top of the sample (to a height of 12 cm of foam). The sample was removed after a certain duration. The sample was extracted with either acetonitrile or carbon tetrachloride. Acetonitrile enabled the observation of polar products in the gas chromatography (GC) and gas chromatography/mass spectrometer (GC/MS) which could not be observed with carbon tetrachloride. After the foam has collapsed the liquid residue, 15 ml, was also analyzed by GC and GC/MS. Hewlett Packard™ HP-6890 GC was used with Flame Photometric™ (6% CNPRPH siloxane), 1 microliter injection sample, 1:100 split, injection temperature 250 C., detector temperature 250 C., oven temperature ramp from 100 to 250 C. over 9.5 minutes, helium flow rate 2 ml/minute. Control experiments were carried out using water plus additives to determine the catalytic effects of the foam.

2. Results

Figure 17:
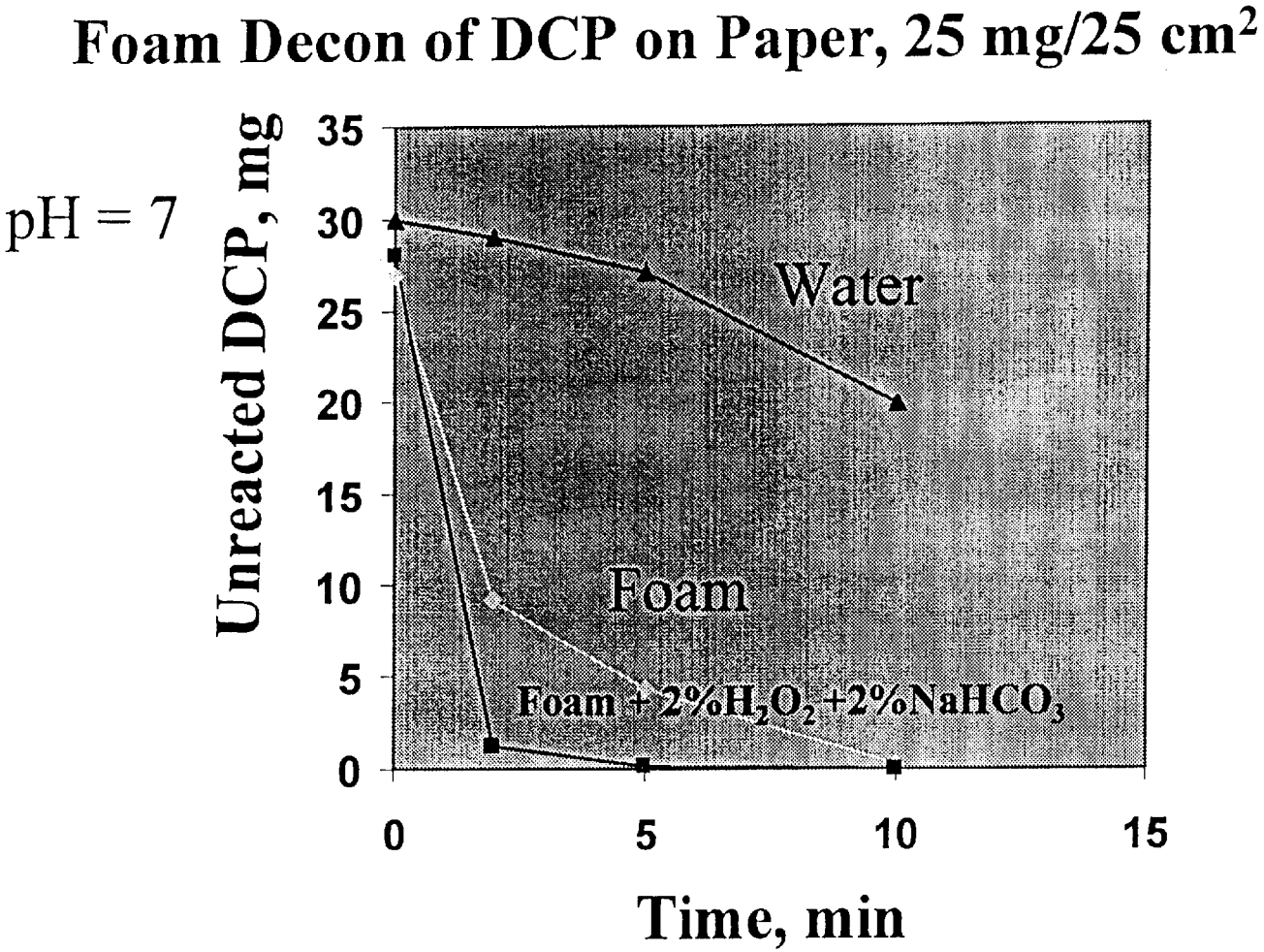
FIG. 17 is a graph showing neutralization results obtained using the foam of the present invention on diphenyl chlorophosphate (a CW simulant).

Diphenyl chlorophosphate. FIG. 17 illustrates a comparison of decontamination effects obtained using the foam of the present invention with results obtained with the foam plus the peroxide/bicarbonate additive and water plus the same additive. The results depicted in FIG. 17 are for the decontamination of 25 mg of diphenyl chlorophosphate on 25 $cm^2$ of regular printing paper (half-life of about 2 minutes). The results demonstrate that the additive in water is not effective, but synergistic enhancement is noted with additive in foam. Similar results are obtained on soda-lime glass surfaces.

Figure 18:
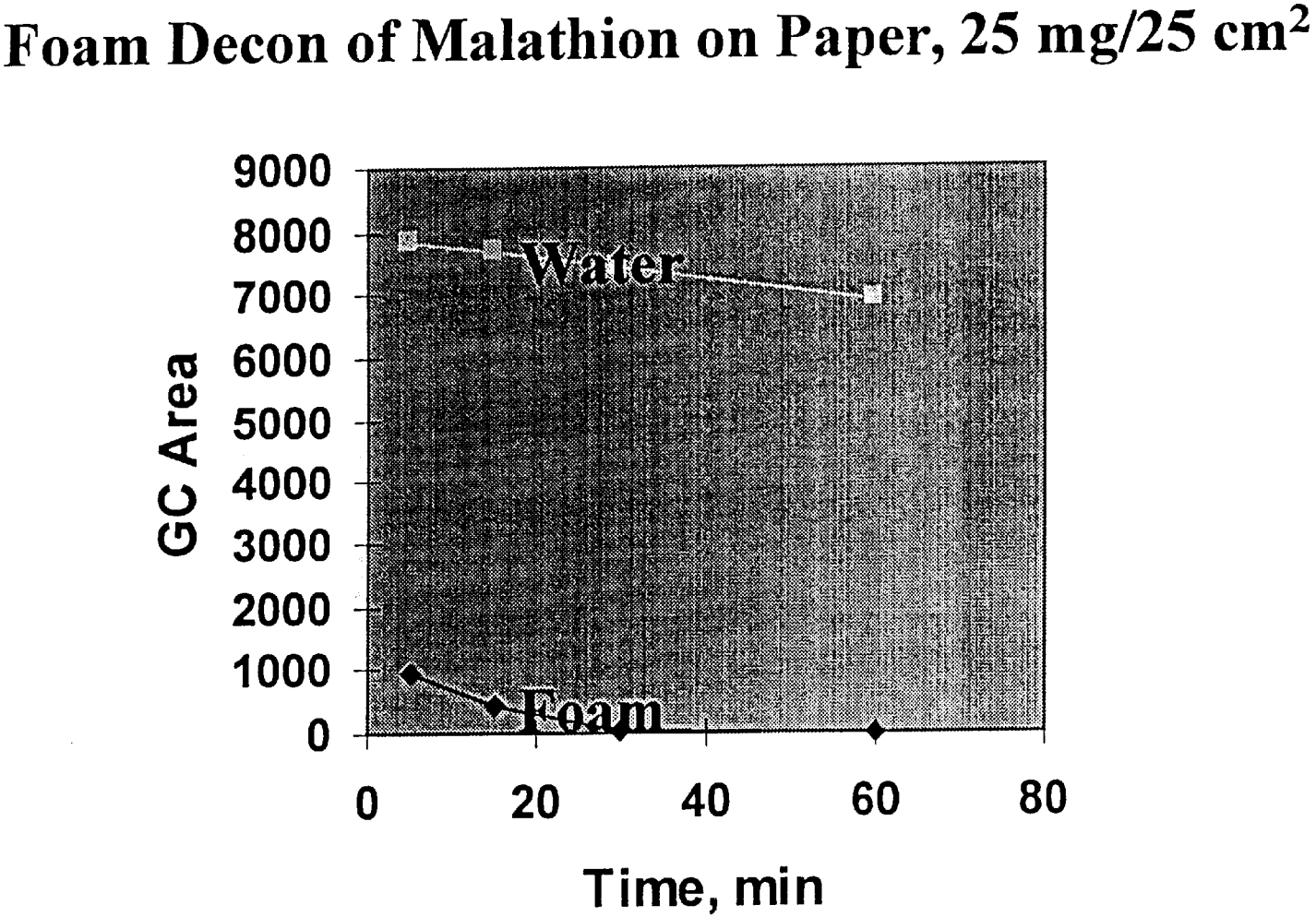
FIG. 18 is a graph showing neutralization results obtained using the foam of the present invention on malathion (a CW simulant).

Malathion. FIG. 18 shows a comparison or results of malathion decontamination on paper using the foam of the invention and using water. On glass (frosted 1 in.×3 in. microscope slides) we observed that some malathion is physically washed-off the glass into the foam liquid. Also the same observation was made in the control experiments using just water. For this reason we analyzed both the surface and the residual liquid for malathion and added to determine the amount of total unreacted malathion. When this was done results on glass were found to be comparable to results on paper.

Nuclear magnetic resonance (NMR) results showed that P—S rather than P—O cleavage occurred, as desired.

Figure 19:
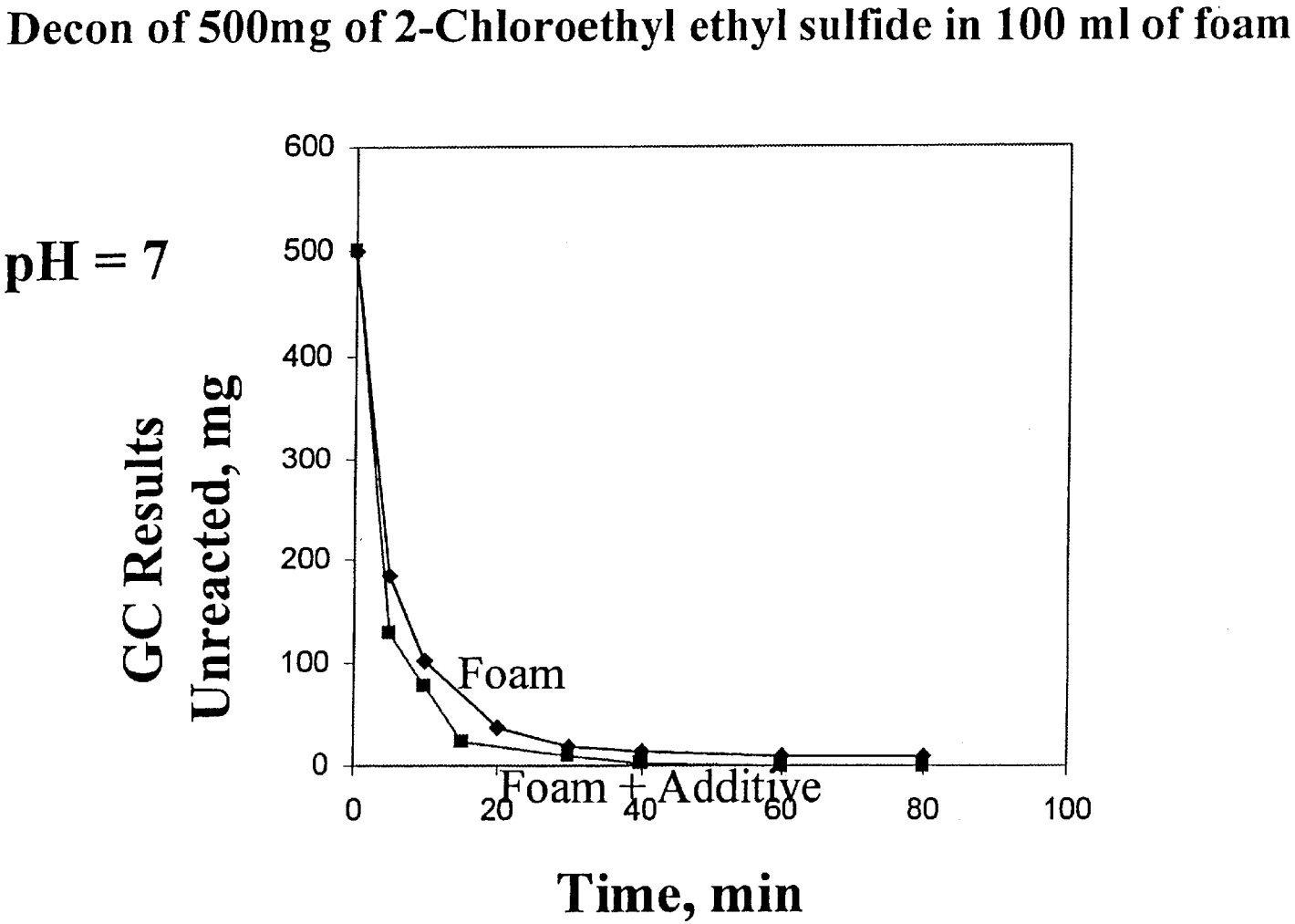
FIG. 19 is a graph showing neutralization results obtained using the foam of the present invention on half-mustard (a mustard simulant).

2-chloroethyl ethyl sulfide (half-mustard). Reliable surface testing with half-mustard cannot be done because it evaporates rapidly from the surface. For this reason, modified experiments were carried out in a closed container using 500 mg of half-mustard and 100 ml of foam. The results from this test are shown in FIG. 19.

Unlike 2-chloroethyl ethyl sulfide, 2-chloroethyl phenyl sulfide does not evaporate quickly and can be used for surface testing. It is recognized, however, that it is much less reactive as compared with mustard gas. Results indicated that the foam reacts with this rather inert material, as shown by NMR analysis data.

BW Simulants

1. Surface Testing with *Bacillus globigii* Spores

*Bacillus globigii* (ATCC 9372) were used in all tests as a surrogate for *Bacillus anthracis*. The bacteria were cultured on Tryptic Soy Agar slants for three days. The bacteria were aseptically transferred to Endospore Agar (Nutrient Agar supplemented with 0.0020% $MnCl_2.4H_2O$)slants and incubated at 37° C. for 17–20 days. The Schaeffer-Fulton staining procedure (with malachite green) was employed to verify sporulation had occurred.

Spore kill tests were conducted in both the foam solution (i.e., test tubes) and in the foamed foam plus glutaraldehyde (3%) additive (surface tests).

Surface test procedure: *B. globigii* spores were suspended in sterile dionized water. A known volume of spore suspension was then deposited on frosted glass plates, air dried under aseptic conditions, and exposed to foamed foam plus additive for 0.5 hours at 25° C. Glass surfaces were then removed from the foam and washed with a stirred sterile salt solution for 2 hours. The foam solution, wash solution, and original spore suspension solution were tested for *B. globigii* spores by plating on Brain-Heart Infusion Agar at $10^0$–$10^{-7}$ serial dilutions and counting after 48 hours.

Figure 20:
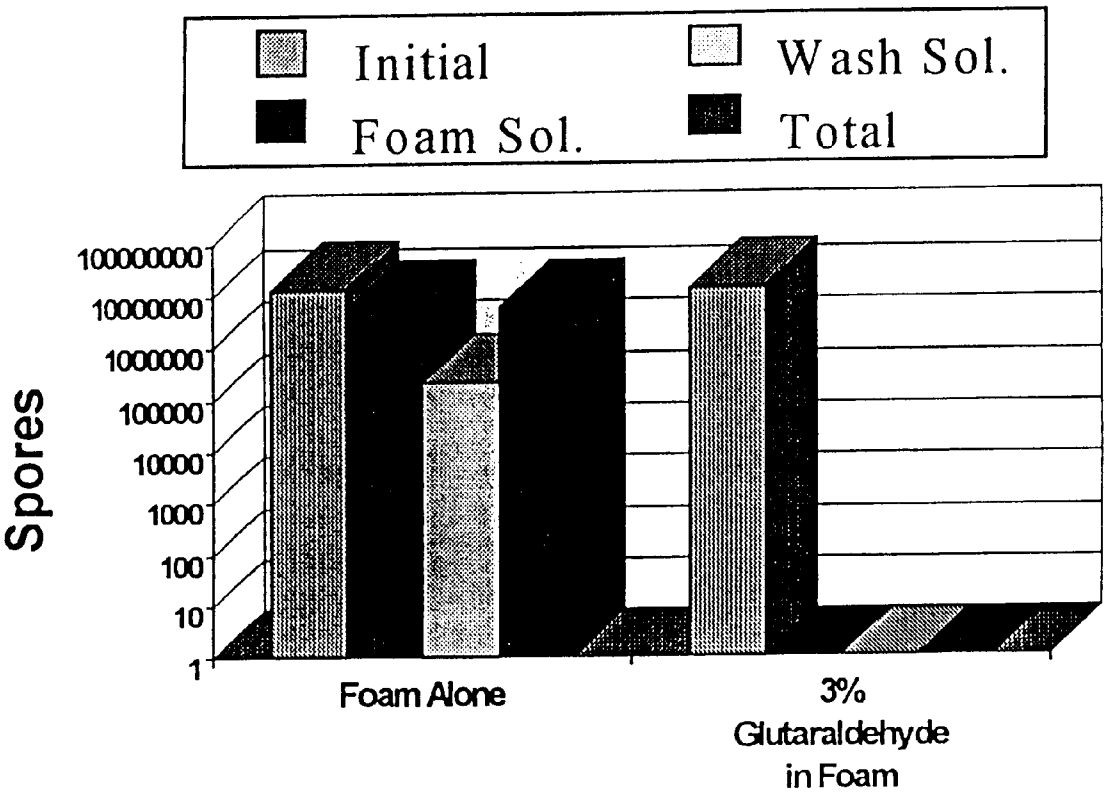
FIG. 20 is a graph showing *B. globigii* spore neutralization results obtained using the foam of the present invention.

Results: FIG. 20 depicts the results obtained following the above procedure. The experiments were started with $10^7$ spores and survivors were observed after a 30 minutes contact time with the foam. Solution experiments were also carried out and confirm the effectiveness of the foam.

2. Solution Testing with *Erwina herbicola*

Figure 21:
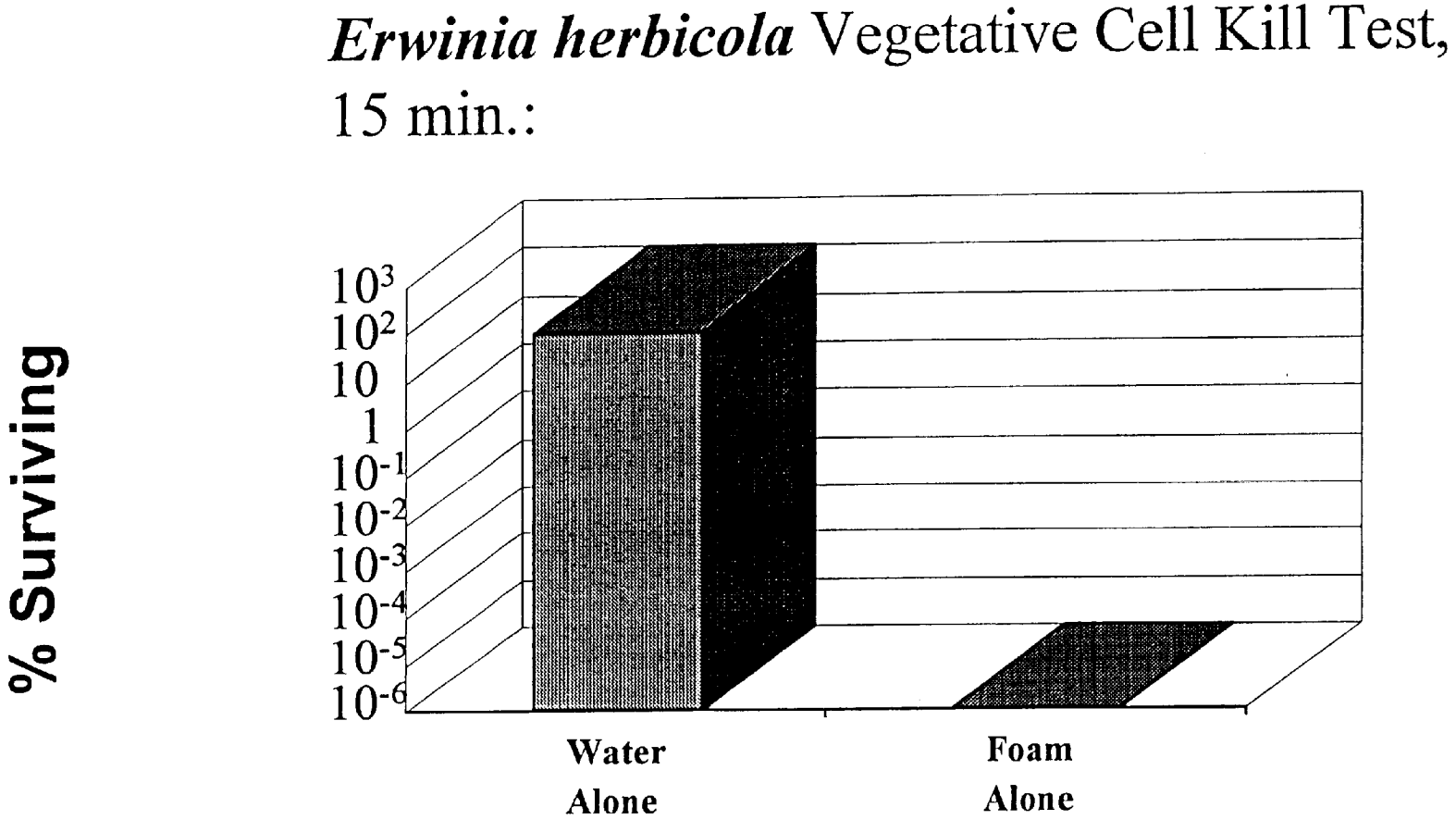
FIG. 21 is a graph showing results of using the foam of the present invention on *E. herbicola.*

We have also demonstrated a complete kill (7-log kill) of *Erwina herbicola* (ATCC 39368) in the foam solution within 15 minutes. The experimental method followed those described above for spore kill tests, except that the bacteria was cultured on tryptic soy agar instead of Brain-Heart Infusion Agar. FIG. 21 illustrates that data indicated a complete kill of the bacteria following exposure to the foam of the present invention.

EXAMPLE 3

Procedure for Foam Preparation

In the following examples, Variquat 80MC is a mixture of benzyl (C12–C16) alkyldimethammonium chlorides; Adogen 477 is a pentamethyltallow alkyltrimethylenediammonium dichloride; and Jaguar 8000 is a Guar Gum, 2-hydroxypropyl ether.

1. Pour 18 L of deionized $H_2O$ into large carboy with largest stir bar available.
2. Add 691.2 g of Adogen 477 (Witco) [hydrotrope]. Rinse beaker used to weigh 477 w/$H_2O$ from carboy, adding rinses back to the carboy.
3. Add 360 g of Alcohol Mix 1 (36.4% isobutanol; 56.4% DEGMBE; 7.3% dodecanol). Note the pH and continue to measure pH throughout the procedure.
4. Add 36 g of Jaguar 8000 [water-soluble polymer]. Add the Jaguar 8000 slowly to avoid lump formation; tap in slowly from spatula. After finished adding the entire Jaguar 8000, stir for 15 minutes. The pH should rise as the Jaguar dissolves. Note: This is a polymer used to slightly increase the viscosity of the water, producing a more stable foam.

5. Slowly adjust the pH of the solution with drop by drop addition of 10% HCl. Adjust to pH=6.5; this only takes a few mis. Stir for 1 hour. The pH is lowered to solubilize the polymer. % HCl: 53.5 ml HCl (37.4%)+146.5 ml $dH_2O$
6. Add 540 g of Variquat 80 MC [surfactant], slowly. Note the pH (will rise). Rinse the beaker used to weigh the Variquat w/solution from the carboy, adding rinses back to the carboy. Remove the pH probe and cover the carboy. Stir for 2 hours.
7. Add 270 g of 1:1 (wt. %) dodecanol and DEGMBE, diethyleneglycol monobutylether. Add dropwise over a 1-hour period. Stir for 1 additional hour. Note final pH of foam. DEGMBE is used as a solvent for the dodecanol. Dodecanol is used to increase the surface tension w/in the laminar wall bilayer of the foam. Increased surface tension provides greater foam stability because the liquid layer between the laminar walls will not drain as fast.
8. Pour the solution into storage bottles.

EXAMPLE 4

Preparation of a 25% Foam Concentrate

1. Mix deionized water (280 g) and Jaguar 8000 polymer (2.6 g). The polymer should be added carefully, over an approximately 5–10 minute period, so clumps do not form. However, if the polymer is added too slowly, it will begin to gel at this ratio of polymer:water. Let the solution stir for 2 hours.
2. Mix Adogen (76.8 g) and Alcohol Mix 1 (40.0 g); add to polymer solution. Adjust pH to 6.5 with 10% HCl. Cover and let stir>1 hour. Note: Alcohol Mix 1 contains 36.4% isobutanol, 56.4% diethylene glycol monobutyl ether (DEGMBE), and 7.3% dodecanol.
3. Add Variquat 80MC (60.0 g) and stir>½ hour.
4. Add the Fatty Alcohol mix (93.4 g). Cover and mix >1 hour. Note: the Fatty Alcohol mix contains 69% DEGMBE, 15% dodecanol, 6% 1-tridecanol, and 10% 1-tetradecanol.

EXAMPLE 5

Field Demonstration of Foam Formulation

A field demonstration was conducted at the U.S. Army Dugway Proving Grounds, UT to determine the efficiency of the foam formulation for the kill of bacterial spores on common office materials. Six test panels (16"×16") were set up and tested. The test panels consisted on ceiling tile, painted wallboard, carpet, painted metal, office partition, and concrete. The panels (except for concrete) were set up in a vertical position. The panels were sprayed with a suspension of *Bacillus globigii* spores, allowed to dry overnight, and sampled for their initial spore concentration. The concentration of formulation sprayed onto each panel was approximately 100 ml per square meter of surface area. The foam formulation (at pH 8.0) was sprayed onto the surface of the test panels and left overnight. After approximately 20 hours, the test panels were sampled for surviving spores. The tests were repeated each day for four consecutive days.

Results for pre-test samples (i.e., contaminated) and post-test samples (i.e., decontaminated) for each day showed that high rates of spore kill (between a minimum of 4 Log kill and a maximum of 7 Log kill) were observed on all office materials that were tested.

EXAMPLE 6

Detoxification of Spores

The following describes an experiment to demonstrate spore kill. 1 ml of test solution is placed in a sterile test tube to which 0.1 ml of a solution of suspended *B. globigii* spores are added. After one hour, the solution is diluted by a factor of ten with sterile deionized water and centrifuged for 30 minutes. The supernatent (liquid) is drawn off using aseptic techniques to leave a pellet of spores in the bottom of the test tube. The spores are resuspended in a 5 ml solution of sterile deionized water and centrifuged again for 30 minutes. The supernatent is again drawn off and the spores are resuspended in 5 ml of sterile deionized water. The solution is centrifuged again and the supernatant is again drawn off. The spores are resuspended in 5 ml of sterile DI water and this solution is plated on a media of brain heart infusion agar using a serial plate dilution series from 10E0 to 10E-7 in sterile petri dishes. The petri dishes are incubated at 37 C. for 48 hours after which colony forming units are counted and recorded. FIG. 16 shows kill of the anthrax surrogate, *B. globigii* after one hour of exposure in a solution of 1) deionized water alone (control), 2) cationic surfactant alone (no hydrogen peroxide and bicarbonate), 3) fatty alcohol alone (no hydrogen peroxide and bicarbonate), 4) cationic hydrotrope alone (no hydrogen peroxide or bicarbonate), 5) hydrogen peroxide and bicarbonate in deionized water (no cationic surfactant or fatty alcohol or cationic hydrotrope), 6) cationic surfactant with hydrogen peroxide and bicarbonate, 6) fatty alcohol with hydrogen peroxide and bicarbonate, and 7) cationic hydrotrope with hydrogen peroxide and bicarbonate. All experiments were conducted at pH 8.0.

From the foregoing description, one skilled in the art can easily ascertain the essential characteristics of the invention defined in this specification and the appended claims, and without departing from the spirit and scope thereof can make various changes and modifications of the invention to adapt it to various usages and conditions. Such changes and modifications as would be obvious to one skilled in the art are intended to be included within the scope of the following claims.

We claim:

1. A formulation for use in the neutralization of at least one toxant, comprising:

at least two solubilizing compounds, wherein at least one solubilizing compound is a cationic surfactant, said cationic surfactant being a quaternary ammonium salt, and at least one solubilizing compound is a cationic hydrotrope, at least one reactive compound, said reactive compound selected from the group consisting of nucleophilic and oxidizing compounds and water to produce an aqueous formulation, said quaternary ammonium salt having a concentration between approximately 0.1 to approximately 10 weight percent of the aqueous formulation, wherein said at least two solubilizing compounds and at least one reactive compound, when mixed with said water and exposed to at least one toxant, neutralizes said at least one toxant.

2. The formulation of claim 1 wherein the quaternary ammonium salt is selected from the group consisting of cetyltrimethyl ammonium bromide, benzalkonium chloride, benzethonium chloride, cetylpyridinium chloride, tetrabutyl ammonium bromide and polymeric quaternary compounds.

3. The formulation of claim 1 further comprising a water-soluble polymer, with concentration between 0 and approximately 10 percent of the aqueous formulation.

4. The formulation of claim 3 wherein the water-soluble polymer is selected from the group consisting of polyvinyl alcohol, guar gum, cationic polydiallyl dimethyl ammonium chloride, non-ionic polydiallyl dimethyl ammonium chloride, and polyacrylamide.

5. The formulation of claim 3 further comprising a corrosion inhibitor.

6. The formulation of claim 5 wherein the corrosion inhibitor is selected from the group consisting of dimethyl ethanolamine, triethanolamine, ethanolamine salts of C9, C10 and C12 diacid mixtures, dicyclohexyl amine nitrite, and N,N-dibenzylamine.

7. The formulation of claim 3 further comprising a fatty alcohol comprised of from 10 to 16 carbon atoms per molecule, with concentration between 0 and approximately 1 percent of the aqueous formulation.

8. The formulation of claim 7 further comprising a catalyst, said catalyst selected from the group consisting of iodosobenzoate and copper amine complexes.

9. The formulation of claim 7 wherein the reactive compound is selected from the group consisting of hydrogen peroxide, urea hydrogen peroxide, hydroperoxycarbonate, oximates, alkoxides, aryloxides, aldehydes, peroxymonosulfate, Fenton's reagent, and sodium hypochlorite.

10. A formulation according to claim 9 used in a kit.

11. The formulation according to claim 10 wherein the kit comprises a premixed component comprising the at least two solubilizing agents, the water-soluble polymer, and the fatty alcohol, and a component consisting of the reactive compound, wherein upon mixing with water can be used in neutralization of at least one toxant.

12. The formulation of claim 9 further comprising water as a carrier medium for said formulation to produce an aqueous formulation capable of detoxification of chemical and biological compounds.

13. The formulation of claim 12 wherein the formulation is at a pH of between approximately 8 and approximately 11.

14. The formulation of claim 12 wherein the formulation is at a pH of approximately 9.

15. The formulation of claim 12 wherein the formulation is in a phase selected from the group consisting of a foam, a fog, a gel, an aerosol, and a liquid.

16. The formulation of claim 15 wherein the foam has an expansion ratio of between approximately 20 and 125.

17. The formulation of claim 15 wherein the cationic hydrotrope is selected the group consisting of from tetrapentyl ammonium bromide, triacetyl methyl ammonium bromide, and tetrabutyl ammonium bromide, with concentration between approximately 0.1 and approximately 10 percent of the aqueous formulation.

18. A formulation for use in neutralization of chemical toxants, comprising:

at least two solubilizing compounds, wherein at least one solubilizing compound is a quaternary ammonium salt and at least one solubilizing compound is a cationic hydrotrope;

a water-soluble polymer;

at least one reactive compound said reactive compound selected from the group consisting of nucleophilic and oxidizing compounds, and;

water in a fluidic phase wherein said at least two solubilizing compounds and at least one reactive compounds, when mixed with said water in a fluidic phase yields a formulation that neutralizes chemical toxants.

19. The formulation of claim 18 wherein the formulation is a foam.

20. The formulation of claim 18 wherein the quaternary ammonium salt has a concentration between approximately 0.1 to approximately 10 weight percent of the aqueous formulation, the cationic hydrotrope is selected from the group consisting of tetrapentyl ammonium bromide, triacetyl methyl ammonium bromide, and tetrabutyl ammonium bromide, with concentration between approximately 0.1 and approximately 10 percent of the aqueous formulation, and the water-soluble polymer is selected from the group consisting of polyvinyl alcohol, guar gum, cationic polydiallyl dimethyl ammonium chloride, non-ionic polydiallyl dimethyl ammonium chloride, and polyacrylamide.

21. A formulation for use in neutralization of biological toxants, comprising:

at least one solubilizing compound, selected from the group consisting of a quaternary ammonium salt, a cationic hydrotrope, and a fatty alcohol comprising 8–20 carbon atoms;

at least one reactive compound, wherein said at least one reactive compound is an oxidizer selected from the group consisting of hydrogen peroxide, urea hydrogen peroxide, and hydroperoxycarbonate;

a peroxide activator which reacts with said at least one reactive compound to form hydroxymonocarbonate; and water, thereby forming a formulation at a pH value of approximately 5 to approximately 12.

22. The formulation of claim 21 further comprising an alcohol having between 2 and 6 carbon atoms.

23. An aqueous formulation for neutralization of at least one toxant, comprising about 4 weight percent of a first quaternary ammonium salt, about 2 weight percent of a first mixture of alcohols, about 0.2 weight percent of a water soluble polymer, about 3 weight percent of a second quaternary ammonium salt, about 1.5 weight percent of a second mixture of alcohols, and about 4 weight percent of oxidizer.

* * * * *